US005752131A

United States Patent [19]

Fujiwara et al.

[11] Patent Number: 5,752,131

[45] Date of Patent: May 12, 1998

[54] DEVELOPING APPARATUS WITH A REMOVABLE SEALING FILM AND PROCESS CARTRIDGE AND IMAGE FORMING APPARATUS INCLUDING SUCH A DEVELOPING APPARATUS

[75] Inventors: Yasuo Fujiwara, Urawa; Hiroo Kobayashi, Yokohama, both of Japan

[73] Assignee: Canon Kabushiki Kaisha, Tokyo, Japan

[21] Appl. No.: 265,936

[22] Filed: Jun. 27, 1994

[30] Foreign Application Priority Data

| | | | |
|---|---|---|---|
| Jun. 25, 1993 | [JP] | Japan | 5-155376 |
| Nov. 1, 1993 | [JP] | Japan | 5-273580 |
| Jan. 19, 1994 | [JP] | Japan | 6-004057 |

[51] Int. Cl.[6] ..... G03G 15/08

[52] U.S. Cl. ..... 399/106; 399/111

[58] Field of Search ..... 355/260, 245, 355/253, 200, 210; 118/653; 222/DIG. 1; 399/102, 103, 106, 105, 119, 262, 111

[56] References Cited

U.S. PATENT DOCUMENTS

| | | | |
|---|---|---|---|
| 4,930,684 | 6/1990 | Patterson | 118/653 X |
| 4,931,838 | 6/1990 | Ban et al. | 355/260 |
| 4,997,016 | 3/1991 | Hacknauer et al. | 355/260 X |
| 5,177,540 | 1/1993 | Honda et al. | 355/260 |
| 5,184,182 | 2/1993 | Michlin | 355/260 |
| 5,229,824 | 7/1993 | Tsusaka et al. | 355/260 |
| 5,258,814 | 11/1993 | Davies | 355/260 |
| 5,282,003 | 1/1994 | Michlin | 355/260 |
| 5,296,902 | 3/1994 | Michlin | 355/260 |
| 5,446,525 | 8/1995 | Kobayashi | 355/210 |

FOREIGN PATENT DOCUMENTS

| | | |
|---|---|---|
| 0101002 | 3/1984 | European Pat. Off. . |
| 0330225 | 8/1989 | European Pat. Off. . |
| 0371520 | 6/1990 | European Pat. Off. . |
| 0387986 | 9/1990 | European Pat. Off. . |
| 0429152 | 5/1991 | European Pat. Off. . |

*Primary Examiner*—S. Lee

*Attorney, Agent, or Firm*—Fitzpatrick, Cella, Harper & Scinto

[57] ABSTRACT

A developing apparatus for developing a latent image formed on an image bearing member includes a first frame having a developer container for containing a developer; a second frame having a developer carrying member for carrying the developer supplied from the developer container to supply the developer to the latent image; a sealing member for sealing an opening for supplying the developer from the developer container to the developer carrying member; wherein the sealing member is pulled between the first frame and the second frame along a pulling path in a pulling direction, whereby the opening is opened and projections, disposed at both sides of the pulling path downstream of the opening in the pulling direction, are provided for limiting the pulling direction of a sealing member.

156 Claims, 26 Drawing Sheets

| TONER CONTAINER | STRENGTH AGAINST PULL (kgf) |
|---|---|
| EX. 1 | 2.1 |
| EX. 2 | 2.2 |
| COMP. EX. 1 | 5.1 |

FIG. 19

| PC | STRENGTH AGAINST OPENING (kgf) |
|---|---|
| EX. 1 | 3.6 |
| EX. 2 | 3.8 |
| COMP. EX. 1 | 8.1 |

FIG. 20

| | STRENGTH AGAINST PULL (kgf) | STRENGTH AGAINST OPENING (kgf) |
|---|---|---|
| EX. 3 | 3.2 | 4.3 |
| EX. 4 | 3.4 | 4.5 |
| COMP. EX. 2 | 6.7 | 10.8 |

FIG. 21

| | STRENGTH AGAINST PRESSURE (gf) | FALLING TEST |
|---|---|---|
| EX. 3 | 510 | NO TNR LEAK |
| EX. 4 | 540 | NO TNR LEAK |
| COMP. EX. 2 | 350 | TNR LEAK |

FIG. 22

| | EXPANSION (mm) | STABILITY AGAINST TEARING |
|---|---|---|
| EX. 5 | 0.75 | SMOOTH |
| EX. 6 | 0.78 | SMOOTH |

FIG. 23

| | REMAINING SEALANT | IMPROPER IMAGE |
|---|---|---|
| EX. 1 | 0 | 0 |
| EX. 2 | 0 | 0 |
| COMP. EX. 1 | 5 | 3 |

FIG. 24

| | CURL (mm) | EXPANSION WIDTH(mm) | TEAR STABILITY |
|---|---|---|---|
| EX. 1-1 | 2.0 | 0.73 | SMOOTH |
| EX. 1-2 | 1.8 | 0.75 | SMOOTH |
| EX. 1-3 | 1.9 | 0.81 | SMOOTH |
| EX. 1-4 | 1.0 | 0.79 | SMOOTH |
| EX. 1-a | 15.5 | —— | —— |
| EX. 1-b | 10.3 | 4.51 | NON-SMOOTH |

| | θ (deg.) | Y6 (mm) | Y2 (mm) | G (mm) | T1 (mm) | T2 (mm) | T (mm) | STRENGTH AGAINST OPENING (kgf) |
|---|---|---|---|---|---|---|---|---|
| SMPL 1 | 160 | 5.0 | 36.5 | 49.0 | 3.5 | 2.0 | 23.0 | 4.1 |
| SMPL 2 | 160 | 5.0 | 36.5 | 49.0 | 3.5 | 2.5 | 28.8 | 5.3 |
| SMPL a | 180 | 5.0 | 36.5 | 49.0 | 3.5 | 3.5 | 49.0 | 10.0 |
| SMPL b | 160 | 5.0 | 36.5 | 49.0 | 3.5 | 3.5 | 40.3 | 8.2 |

FIG. 37

| | STRENGTH AGAINST PUNCTURE (gf) | FALL TEST |
|---|---|---|
| SMPL 1 | 330 | NO TNR LEAK |
| SMPL 2 | 330 | NO TNR LEAK |
| SMPL a | 330 | NO TNR LEAK |
| SMPL b | 335 | NO TNR LEAK |

FIG. 38

| | θ (deg.) | Y6 (mm) | Y2 (mm) | G (mm) | T1 (mm) | T2 (mm) | T (mm) | STRENGTH AGAINST OPENING (kgf) |
|---|---|---|---|---|---|---|---|---|
| SMPL 3 | 160 | 5.0 | 36.5 | 49.0 | 3.5 | 2.0 | 23.0 | 4.5 |
| SMPL 4 | 160 | 5.0 | 36.5 | 49.0 | 3.5 | 2.5 | 28.8 | 6.0 |
| SMPL c | 180 | 5.0 | 36.5 | 49.0 | 3.5 | 3.5 | 49.0 | 11.2 |
| SMPL d | 160 | 5.0 | 36.5 | 49.0 | 3.5 | 3.5 | 40.3 | 9.5 |

FIG. 39

| | STRENGTH AGAINST PUNCTURE (gf) | FALL TEST |
|---|---|---|
| SMPL 3 | 435 | NO TNR LEAK |
| SMPL 4 | 435 | NO TNR LEAK |
| SMPL c | 440 | NO TNR LEAK |
| SMPL d | 440 | NO TNR LEAK |

FIG. 40

| | θ (deg.) | Y6 (mm) | Y2 (mm) | G (mm) | T1 (mm) | T2 (mm) | T (mm) | STRENGTH AGAINST OPENING (kgf) |
|---|---|---|---|---|---|---|---|---|
| SMPL 5 | 160 | 5.0 | 30.0 | 40.0 | 3.0 | 2.0 | 23.0 | 4.1 |
| SMPL 6 | 130 | 9.5 | 30.0 | 40.0 | 3.0 | 2.0 | 9.5 | 2.0 |
| SMPL e | 85 | 24.0 | 30.0 | 40.0 | 3.0 | 2.0 | 5.4 | 1.2 |

FIG. 41

| | STRENGTH AGAINST PUNCTURE (gf) | FALL TEST |
|---|---|---|
| SMPL 5 | 320 | NO TNR LEAK |
| SMPL 6 | 320 | NO TNR LEAK |
| SMPL e | 170 | TNR LEAK |

FIG. 42

| | θ (deg.) | Y6 (mm) | Y2 (mm) | G (mm) | T1 (mm) | T2 (mm) | T (mm) | STRENGTH AGAINST OPENING (kgf) |
|---|---|---|---|---|---|---|---|---|
| SMPL 7 | 160 | 5.0 | 30.0 | 40.0 | 3.0 | 2.0 | 23.0 | 4.3 |
| SMPL 8 | 130 | 9.5 | 30.0 | 40.0 | 3.0 | 2.0 | 9.5 | 2.3 |
| SMPL f | 85 | 24.0 | 30.0 | 40.0 | 3.0 | 2.0 | 5.4 | 1.5 |

FIG. 43

| | STRENGTH AGAINST PUNCTURE (gf) | FALL TEST |
|---|---|---|
| SMPL 7 | 415 | NO TNR LEAK |
| SMPL 8 | 415 | NO TNR LEAK |
| SMPL f | 203 | TNR LEAK |

FIG. 44

DEVELOPING APPARATUS WITH A REMOVABLE SEALING FILM AND PROCESS CARTRIDGE AND IMAGE FORMING APPARATUS INCLUDING SUCH A DEVELOPING APPARATUS

FIELD OF THE INVENTION

The present invention relates to a developing apparatus, a process cartridge and an image forming apparatus. The image forming apparatus includes an electrophotographic copying machine or a printer, using a developer.

DESCRIPTION OF THE RELATED ART

An electrophotographic type image forming apparatus is widely used as in a copying machine or the like. In such an apparatus, a photosensitive drum 7 is uniformly charged and is selectively exposed to form a latent image. The latent image is visualized with a developer, and the visualized image is transferred onto a recording material. In such an apparatus, a photosensitive drum and a developing device having a developer container or the like are unified into a cartridge. The cartridge is mounted to a main assembly of the apparatus. The latent image formed on the photosensitive drum is developed using a developer accommodated in the developer container in the cartridge.

In order to prevent leakage of the developer from the container during transportation, the opening of the developer container is sealed by a sealing member. Prior to the start of use, the operator removes the sealing member to open the developer container, by which the developer contained in the container is supplied to the developing roller or the like through the opening. When the operator opens the container, if the operator pulls the sealing member obliquely through an error, the opening action is not performed as desired with the result that a desired opening region is not provided. When the user pulls the sealing member, the sealing member rubs the end sealing member with the result that the sealing member is peeled off the frame with the result of larger force required for pulling the sealing member. In addition, the developer leaks from the peeled portion.

SUMMARY OF THE INVENTION

Accordingly, it is an object of the present invention to provide a developing apparatus, process cartridge and an image forming apparatus in which the operativity in removing the sealing member is improved.

It is another object of the present invention to provide a developing apparatus, process cartridge and an image forming apparatus in which the developer is effectively prevented from leaking out.

It is a further object of the present invention to provide a developing apparatus, process cartridge and an image forming apparatus in which the operativity when the operator uses the cartridge, is improved.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 19 is a table of experimental results of strength of a tear tape against pulling.

FIG. 20 is a table of experimental results of strength against opening of the process cartridge.

FIG. 21 is a table of experimental results of strength against opening of the process cartridge and a strength of tear tape against pulling.

FIG. 22 is a table of experimental results about strengths of the toner container and the process cartridge against pressure and falling tests.

FIG. 23 is a table of experimental results about tear expansion of the cover seal and stability of tearing, when the tear tape is pulled.

FIG. 24 is a table of experimental results about residual sealant and improper image formation, when the tear tape is pulled out.

FIG. 37 is a table of seal pattern dimensions for heat seal of the sealing member in experiment 2-1.

FIG. 38 shows results of puncture strength and falling tests in experiment 2-1.

FIG. 39 is a table of seal pattern dimensions for heat seal of the sealing member in experiment 2-2.

FIG. 40 is a table of results of puncture strength and falling tests in experiment 2-2.

FIG. 41 is a table of seal pattern dimensions for heat seal of the sealing member in experiment 2-3.

FIG. 42 is a table of puncture strength and falling tests in experiment 2-3.

FIG. 43 is a table of seal pattern dimension for heat seal of the sealing member.

FIG. 44 is a table of results of the puncture strength and falling tests in experiment 2-4.

DESCRIPTION OF THE PREFERRED EMBODIMENTS

Referring to the accompanying drawings, a first embodiment of the present invention will be described.

Embodiment 1

Figure 1:
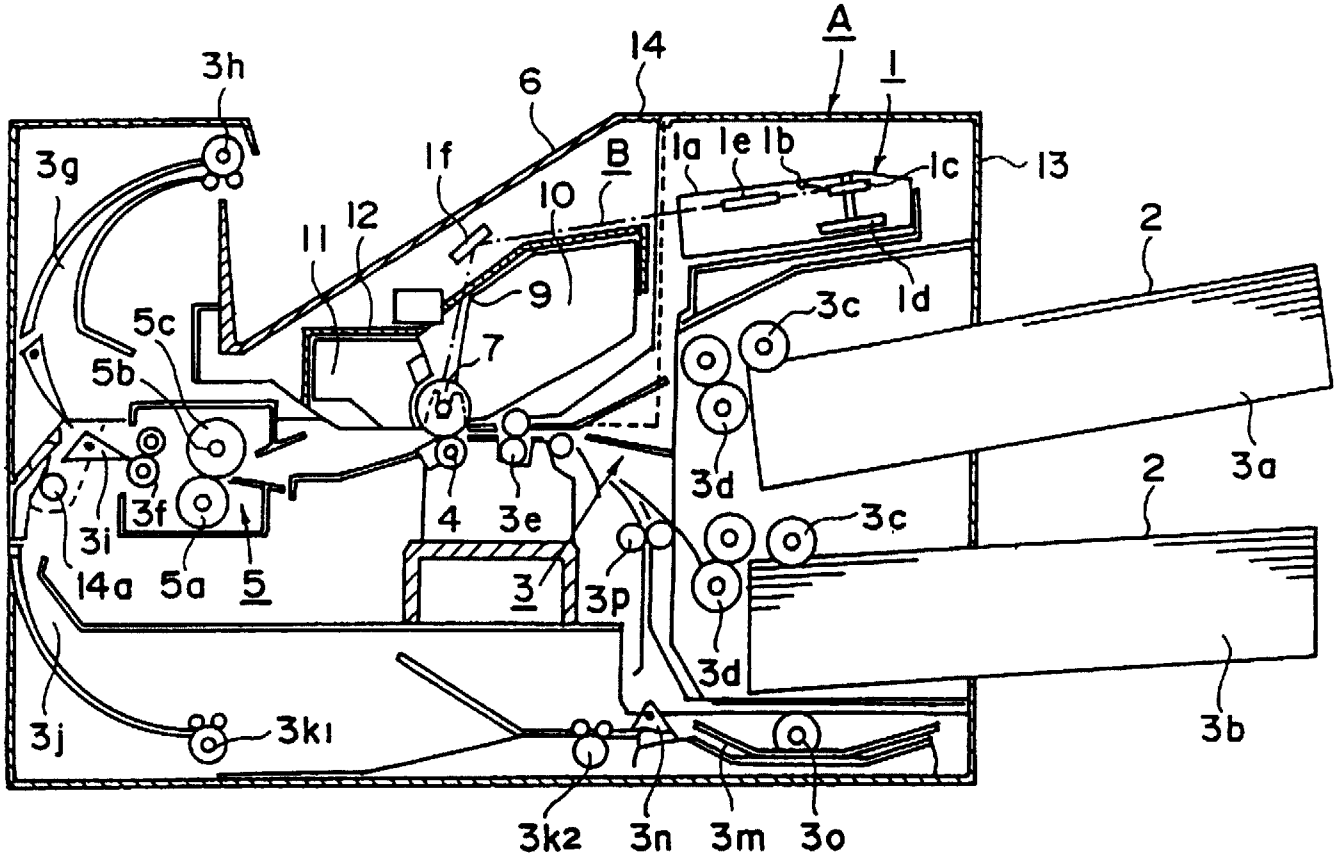
FIG. 1 is a sectional view of an image forming apparatus according to an embodiment of the present invention.
Figure 2:
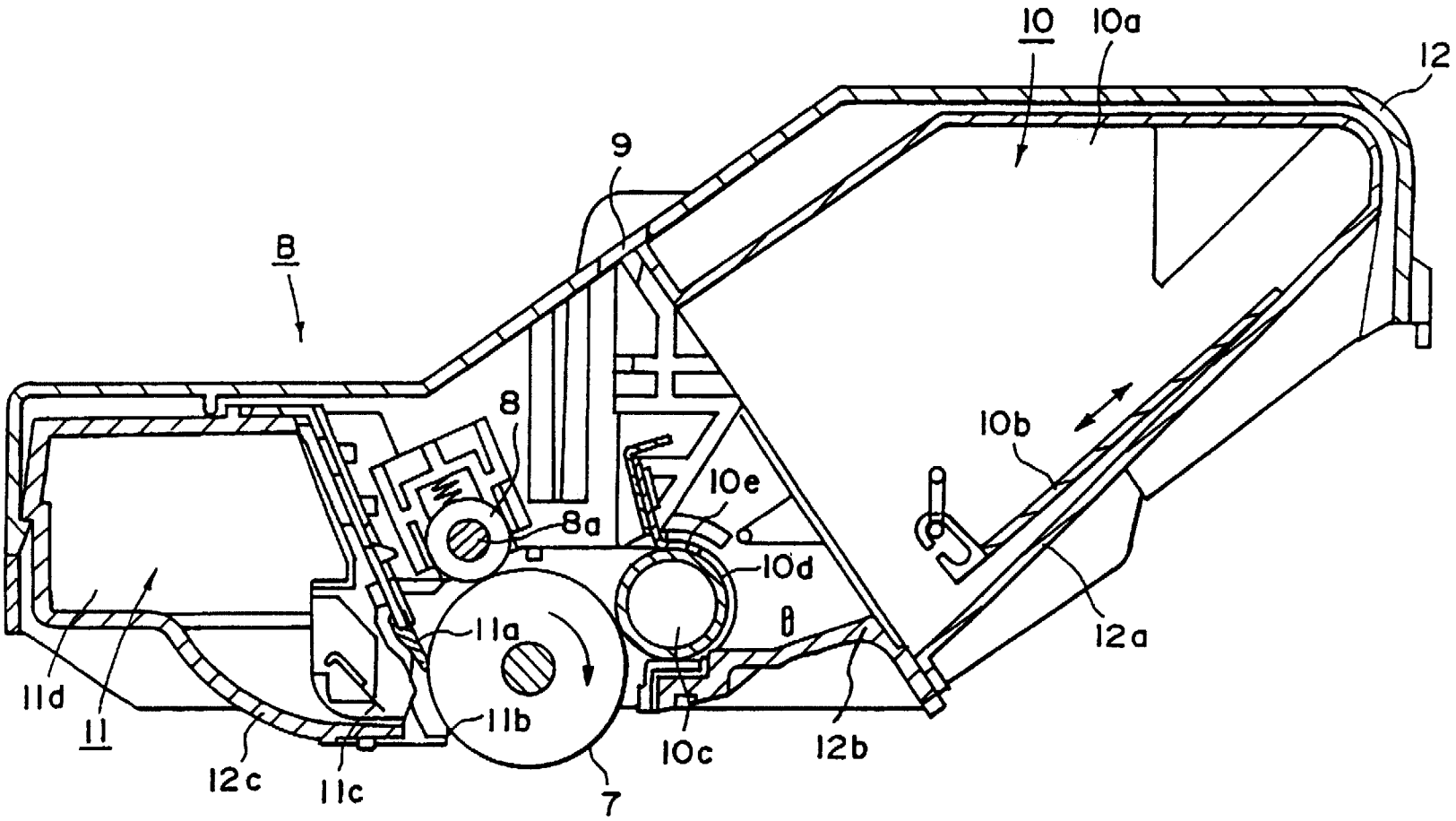
FIG. 2 is a sectional view of a process cartridge according to an embodiment of the present invention.

FIG. 1 is a sectional view of an image forming apparatus loaded with a process cartridge, according to an embodiment of the present invention. FIG. 2 is a sectional view of the process cartridge.

(General description)

The image forming apparatus A, as shown in FIG. 1, projects light image bearing image information from an optical system 1 to a photosensitive drum which is an example of the image bearing member, and a developed image is formed on the photosensitive member. In synchronism with the toner image formation, the recording material 2 is fed by feeding means 3, and an image forming station which is in the form of a cartridge (process cartridge B), the toner image is transferred onto a recording material from the photosensitive drum by transfer means 4. The recording material 2 is fed to fixing means 5, where the toner image is fixed on the recording material, and the recording material is discharged to a discharge station.

A process cartridge B constituting the image forming station, as shown in FIG. 2, is such that the photosensitive drum 7 is rotated while the surface thereof is uniformly charged by charging means 8, and the light image from the optical system 1 is projected onto the photosensitive drum 7 through the exposure station 9, so that a latent image is formed. The latent image is developed into a toner image by developing means 10. The toner image is transferred therefrom onto the recording material 2 by the transfer means 4, and thereafter, the residual toner remaining on the photosensitive drum 7 is removed by cleaning means. Various parts such as the photosensitive drum 7 or the like are contained in a housing, so that they constitute a cartridge.

The description will be made as to various parts of the image forming apparatus A and the process cartridge B. The description will be further made as to a mounting member 15 for mounting the photosensitive drum 7 onto a cleaning container 12*c*, and a sealing member mounted to a toner container 12*a* around an opening thereof.

(Image forming apparatus)

The description will be made as to an optical system, feeding means, transfer means, fixing means and cartridge mounting means in this order.

(Optical system)

The optical system products the light beam carrying image information provided by an external apparatus or the like, onto the photosensitive member 7. As shown in FIG. 1, it comprises an optical unit 1*a* containing a laser diode 1*b*, a polygonal mirror 1*c*, a scanner motor 1*d* and an image forming lens 1*e*.

When an image signal is sent from external equipment such as a computer or word processor, the laser diode 1*b* emits light in response to the imaging signal, and the emitted light is projected as the imaging beam to the polygonal mirror 1*c*, which is being rotated at a high speed by a scanner motor 1*d*. The imaging beam reflected by the polygonal mirror 1*c* is projected through the image forming lens 1*e* and is reflected by the mirror 1*f* onto the photosensitive drum 7, exposing selectively the surface thereof. As a result, a latent image is formed on the drum in accordance with the image information.

(Recording material feeding means)

The description will be made as to the structure of feeding means 3 for feeding the recording material (recording sheet, OHP sheet, cloth or thin sheet, for example). In this embodiment, two cassettes 3*a* and 3*b* are usable, so that two kinds of recording materials 2 can be selectively fed. In addition, one side or both-side printing is possible.

When either of cassette 3*a* or cassette 3*b* is selected, the topmost sheet is fed by a pick-up roller 3*c* and a separation roller pair 3*d* in the selected cassette. Then, it is fed to a registration roller pair 3*e*. The registration roller pair 3*e* is driven in synchronism with the image forming operation to feed the recording material 2 to an image transfer position where the photosensitive drum 7 and the transfer roller 4 are contacted.

The recording material 2 having received the toner image is fed to image fixing means 5, where the toner image is fixed. In the case of a single side printing mode selected, the recording material is fed along the discharge passage 3*g* by an intermediate feeding roller pair 3*f*, and is then discharged to a discharge portion 6 by a discharging roller pair 3*h* with the record side facing down.

In the case of duplex printing (both-side printing), a flapper 3*i* swings so that the recording material after having received an image on one side is fed to a refeeding passage 3*j* by intermediate feeding roller pair 3*f*, and is temporarily stored in a refeeding station by refeeding rollers 3*k*1 and 3*k*2. When it is to be refed, the flapper 3*n* swings to permit the recording material stored in the refeeding station 3*m* by a pick-up roller 3*o* and feeding roller pairs, 3*p* to the registration roller pairs 3*e*. Then, the opposite side of the recording material is subjected to the image formation.

(Transfer means)

The transfer means 4 transfers the toner image formed on the photosensitive drum 7 onto a recording material. The transfer means 4 of this embodiment, as shown in FIG. 1, is constituted by a transfer roller 4. By the transfer roller 4 the recording material 2 is pressed to the photosensitive drum 7 in the process cartridge B, while the transfer roller 4 is supplied with a voltage having a polarity opposite to that of the toner image formed on the photosensitive drum 7, so that the toner image is transferred onto a recording material 2 from the photosensitive drum 7.

(Fixing means)

The fixing means 5 functions to fix the toner image having been transferred by the voltage applied to the transfer roller 4. As shown in FIG. 1, the fixing means 5 comprises a driving roller 5*a*, and an inside heater 5*b* and a fixing roller 5*c* driven by the driving roller 5*a* by the press-contact therebetween. When the recording material having the toner image passes through a nip formed between the driving roller 5*a* and the fixing roller 5*c*, the pressure is applied by the nip between the rollers 5*a* and 5*c*, while being subjected to heat produced by the fixing roller 5*c*, by which the toner image is fixed on the recording material 2.

(Process cartridge mounting means)

Figure 3:
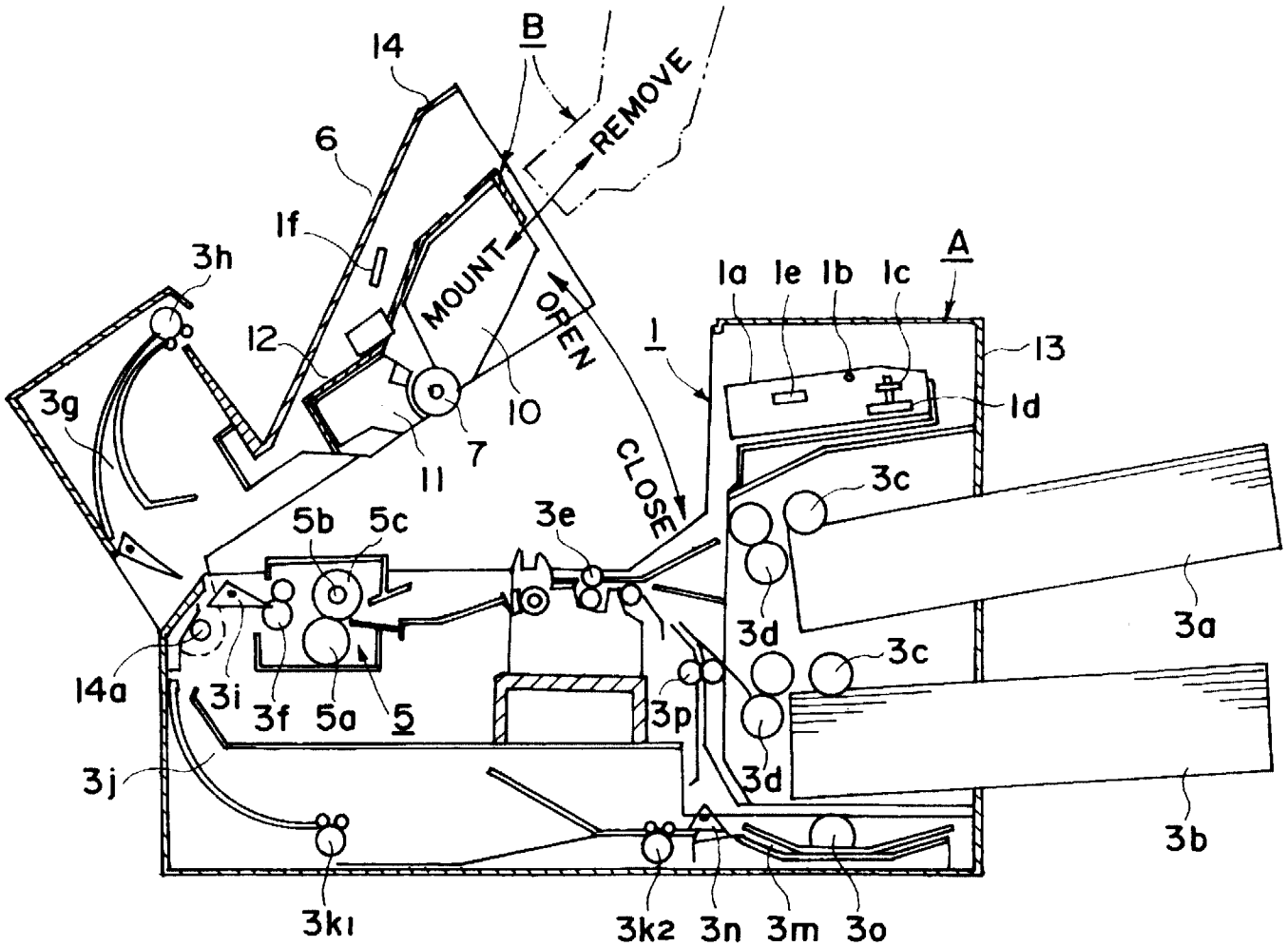
FIG. 3 is a sectional view of the image forming apparatus when it is opened.

In the image forming apparatus A, there is provided a cartridge mounting means for securedly receiving the process cartridge B. As shown in FIG. 3, the mounting or demounting of the process cartridge B relative to the main assembly 13 is effected after opening the opening member 14. The upper part of the main assembly 13 is provided with an opening member 14 operable by a hinge 14*a*. When the opening member 14 is opened, there is a cartridge guiding member (not shown) at the left and right inside surface of the opening member 14. These guiding members function as a guide for insertion of the process cartridge B. The process cartridge B is inserted along the guide, and then the opening member 14 is closed, by which the process cartridge B is mounted to the image forming apparatus A.

(Process cartridge)

The description will be made as to the process cartridge B mounted to the image forming apparatus A.

This process cartridge B comprises an image bearing member and at least one processing means. As for the processing means, there are for example, a charging means for charging the surface of the image bearing member, a developing means for forming a toner image on the image bearing member, a cleaning means for cleaning the residual toner from the image bearing member surface, or the like. The process cartridge B of this embodiment comprises an electrophotographic photosensitive drum 7 as the image bearing member, a charging means 8, an exposure means 9, a developing means 10, and cleaning means 11, wherein the photosensitive drum 7 is surrounded thereby, as shown in FIG. 2. These processing means are integrally contained in a housing, thus forming an exchangeable cartridge which can be loaded into or taken out of the main assembly of the apparatus.

The parts of the process cartridge B will be described in the order of photosensitive drum 7, charging means 8, exposure means 9, developing means 10 and cleaning means 11.

(Photosensitive drum)

The photosensitive drum 7 in this embodiment comprises a drum base of cylindrical aluminum and an organic photoconductive layer applied thereon. The photosensitive drum 7 is mounted rotatably on the housing 12. A flange gear mounted to one longitudinal end of the drum 7 is driven by a driving force from a driving motor provided in the main assembly, by which the photosensitive drum 7 is rotated in a direction indicated by an arrow in FIG. 2 in accordance with image forming operation.

(Charging means)

A charging means functions to uniformly charge the surface of the photosensitive drum 7, and in this embodiment, it is a so-called contact charging type in which a charging roller 8 is rotatably mounted on a cleaning container 12*c*. The charging roller 8 comprises a metal roller shaft 8*a*, an electroconductive elastic layer thereon, a high resistance elastic layer and a surface protection layer. The electroconductive elastic layer comprises a carbon dispersed in an elastic rubber layer of EPDM or NBR or another elastic rubber layer. It is effective to introduce a bias voltage from the roller shaft 8*a*. The high resistance elastic layer is of urethane rubber or the like, and as an example, it contains a small amount of electroconductive fine powder. It is effective to limit leakage current to the photosensitive drum 7 to prevent sudden bias voltage drop even when the charging roller is contacted to a high electroconductivity portion such as a pin hole of the photosensitive drum 7. The protection layer is constituted by N-methylmethoxynylon, so that plastic material in the high resistance elastic layer or in the electroconductive elastic layer is not directly contacted to the photosensitive drum 7 so as to not deteriorate the surface of the photosensitive drum 7.

The charging roller 8 is contacted to the photosensitive drum 7, and for the image formation, the charging roller 8 is driven by the rotation of the photosensitive drum 7, and the superimposed application of the DC voltage and the AC voltage to the charging roller 8 is effective to uniformly charge the surface of the photosensitive drum 7.

(Exposure means)

The exposure station 9 is effective to expose the surface of the photosensitive drum 7 uniformly charged by the charging roller 8 to light image supplied from an optical system 1, thus forming an electrostatic latent image on the surface of the drum 7. An opening 9 for introducing the light image formed in the top surface of the housing 12 constitutes the exposure means.

(Developing means)

As shown in FIG. 2, the developing means 10 comprises a toner container 10*a* for containing toner, and toner feeding member 10*b*, reciprocable in the direction indicated by an arrow to feed the toner in the toner container 10*a*. Non-rotatable magnet 10*c* is provided therein. By the rotation thereof, a developing sleeve 10*d* carrying a thin toner layer, is fed to a developing zone where the developing sleeve 10*d* is spaced from a photosensitive drum 7 with a small gap.

When the toner layer is to be formed on the surface of the developing sleeve 10*d*, the toner and the developing sleeve 10*d* are contacted to triboelectrically charge the toner to a sufficient extent to develop the latent image on the photosensitive drum 7. In order to regulate the layer thickness of the toner, there is provided a blade 10*e*, as shown.

(Cleaning means)

The cleaning means 11, as shown in FIG. 2, comprises a cleaning blade 11*a* for scraping toner off the drum 7 by contact to the surface thereof, a receptor sheet 11*b* disposed below the blade 11*a* lightly contacted to the surface of the photosensitive drum 7 to receive the toner scraped by the cleaning blade 11*a*, a member 11*c* for feeding to a rear part of the container the residual toner received thereby, and a residual toner container 11*d* for containing the removed residual toner.

(Photosensitive drum mounting member)

Figure 4:
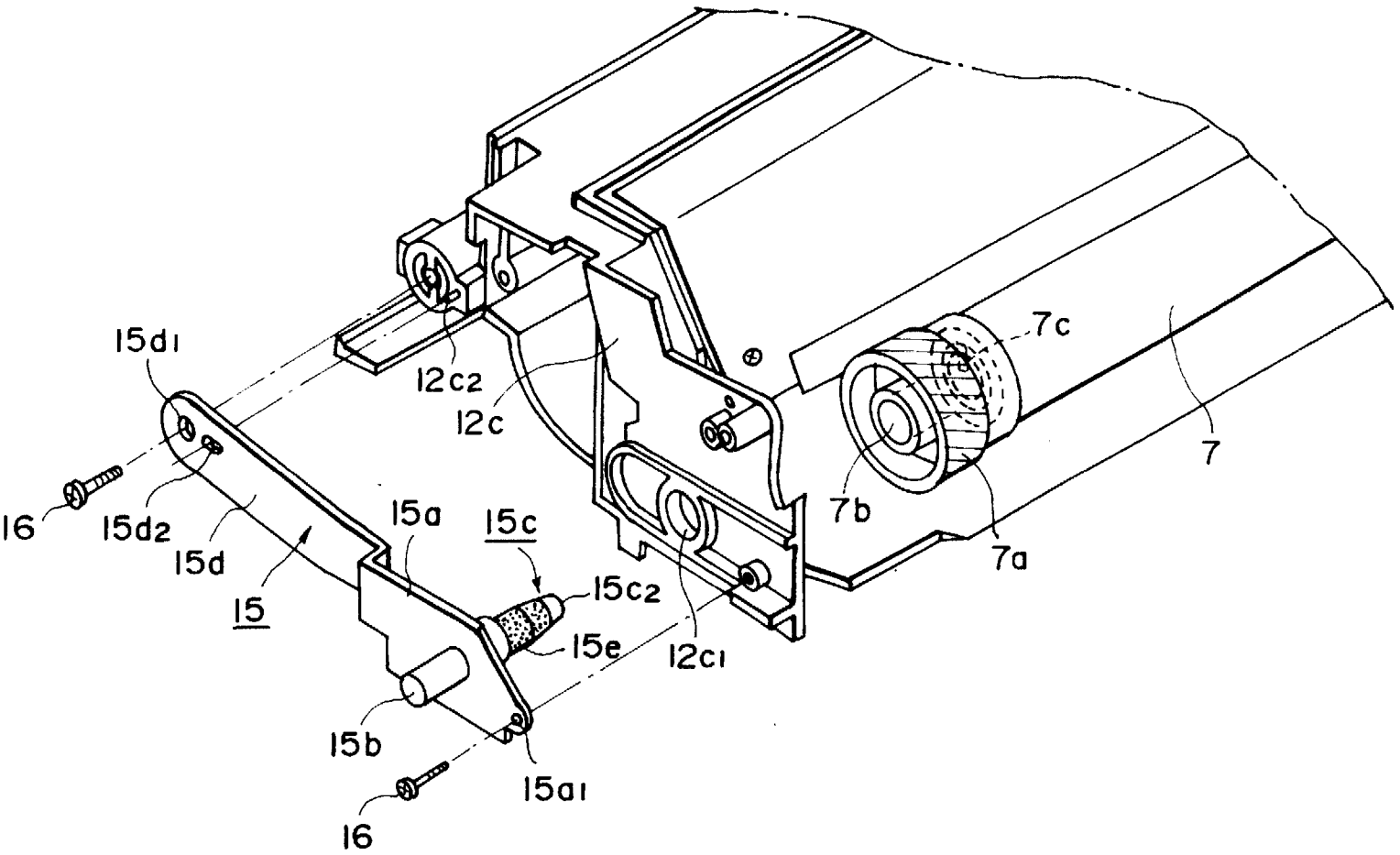
FIG. 4 illustrates a photosensitive drum mounting member.

The description will be made as to mounting member for rotatably mounting the photosensitive drum to the housing 12. As shown in FIG. 4, to one end of the cylindrical aluminum base of the photosensitive drum 7, a flange gear 7*a* is mounted. The flange gear 7*a* is injection-molded from an insulative plastic material such as polycarbonate resin or polyacetal resin or the like. It is press-fitted to the end of the drum base, or it is securedly fixed by an adhesive. The supporting member 15 is inserted into a bore 7*b* formed in the flange gear 7*a* to rotatably support the photosensitive drum 7.

As shown in FIG. 4, the mounting member 15 comprises a first conductive member 15*b* projected from one side surface of the base 15*a*, and a second conductive member 15*c* projected from the other side of the base 15*a*. An extension 15*d* is extended from the base 15*a*. A plastic material cylindrical member 15*e* is mounted to an end of the second conductive member 15*c*.

The first conductive member 15*b* is an electric contact for electrically grounding the photosensitive drum 7. When the process cartridge B is mounted in the main assembly 13, the first conductive member 15*b* is contacted to a grounding contact (not shown) of the main assembly 13.

Figure 5:
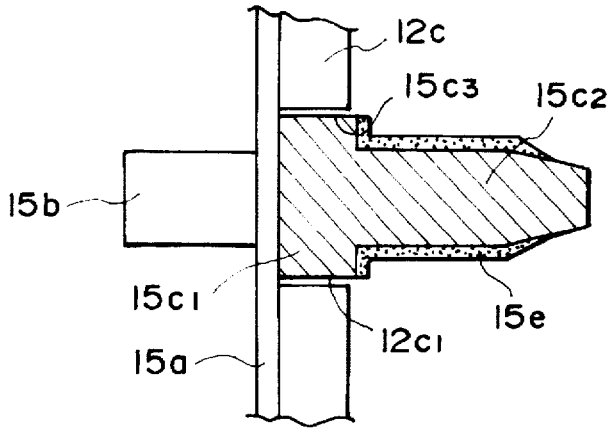
FIG. 5 is a sectional view of a second conductive member of the mounting member.

On the other hand, the second conductive member 15*c* is inserted into the bore 7*b* of the flange gear 7*a* to rotatably support the photosensitive drum 7. As shown in FIG. 5, a base portion 15*c*1 received by a bore 12*c*1 of the cleaning device 12*c*, and a shaft portion 15*c*2 received by the bore 7*b* of the flange gear 7*a*, are integrally formed through a stepped portion 15*c*3. An end of the shaft 15*c*2 is converged toward the end for easy insertion into the bore 7*b*.

When the second conductive member 15*c* is inserted into the bore 7*b* of the flange gear 7*a*, the end thereof is brought into contact with a contact 7*c* (FIG. 4) in the photosensitive drum 7, and the photosensitive drum 7 is electrically connected with the electric ground of the main assembly 13 through the second and first conductive members 15*c* and 15*b*. For this purpose, the first and second conductive members 15*b* and 15*c* are of electroconductive material. For example, it may be a steel, stainless steel, brass, aluminum or the like plated with nickel chrome. In this embodiment, the base 15*a* and the extension 15*d* are integrally formed with the first and second conductive members 15*b* and 15*c*.

The plastic cylindrical member 15*e* is made of a material exhibiting sufficient sliding property relative to the flange gear 7*a*. The examples include polyacetal, polybutylene terephthalate, polycarbonate or the like material. It may be outsert-molded on the shaft portion 15*c*2 of the second conductive member 15*c*, or a cylindrical member 15*e* is press-fitted to the shaft portion 15*c*2. Further alternatively, it may be bonded by an adhesive. When the cylindrical member 15*e* is inserted into the bore 7*b* of the flange gear 7*a*, it is contacted to the inside peripheral surface of thee bore 7*b* to support the photosensitive drum 7. Therefore, when the image formation is carried out using the process cartridge B mounted, the flange gear 7*a* is in sliding contact with the plastic material cylindrical member 15*e* of the mounting member 15, and therefore, the sliding property is improved.

For this reason, the scraping of the flange gear 7*a* of the plastic material by sliding contact with the metal shaft, is prevented, as contrasted to the prior art. In addition, the noise production can be avoided.

Since the cylindrical member 15*e* is of insulative material, the current to be fed to the electric ground is prevented from flowing into the other path such as flange gear 7*a* or the like.

Figure 6A:
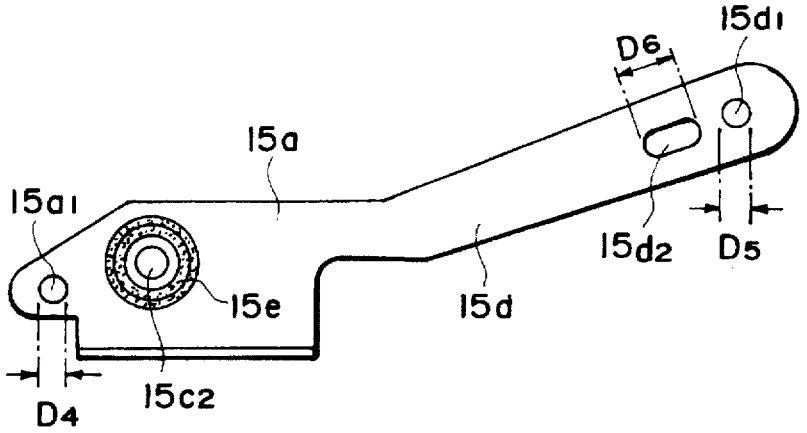
FIGS. 6A and 6B show dimensions of the mounting member.
Figure 6B:
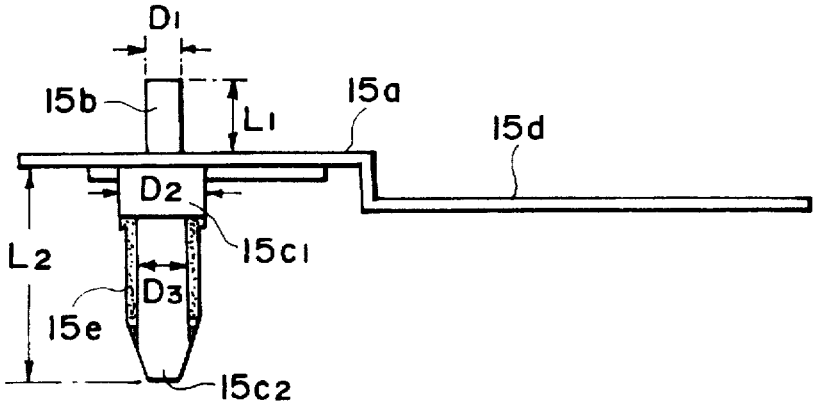

Referring to FIGS. 6A and 6B, dimensions of various parts of the mounting member 15 in this embodiment will be given. FIG. 6A is a front view of the mounting member 15 as seen from the second conductive member 15*c*. FIG. 6B is a sectional plan view.

A diameter D1 of the first conductive member 15*b*: approx. 8 mm.

A projected length L1 of the first conductive member 15*b* from the base 15*a*: approx. 12 mm.

Diameter D2 of the base portion of the second conductive member: approx. 12 mm.

Diameter D3 of the shaft portion of the second conductive member 15*c*: approx. 10 mm.

Projected length L2 of the second conductive member 15*c* from the base 15*a*: approx. 25 mm.

Diameter D4 of a hole 15*a*1, for a screw, of the extension: approx. 4 mm.

Diameter D5 of a hole 15*d*1, for a screw, of the extension: approx. 4 mm.

Diameter D6 of an elongated hole 15*d*2: approx. 4 mm.

In order to mount the photosensitive drum 7 to the cleaning frame 12*c* by the mounting member 15, as shown in FIG. 4, the shaft portion 15*c*2 of the mounting member 15 is inserted into the bore 7*b* of the flange gear 7*a* mounted on the photosensitive drum 7 through a hole 12*c*1 of the cleaning container 12*c*. At this time, an end portion of the shaft portion 15*c*2 is contacted to a ground contact 7*c* in the photosensitive drum 7. An elongated hole or slot 15*d*2 in the extension 15*d* is engaged in the positioning boss 12*c*2 of the cleaning container 12*c*, and a screw 16 is threaded to the cleaning container 12*c* through the holes 15*a*1 and 15*d*2 formed in the base 15*a* and the extension 15*d*, respectively, thus securing the mounting member 15 to the cleaning container 12*c*.

Similarly, at the other longitudinal end of the photosensitive drum 7, the shaft portion of the mounting member is inserted into a bore of the flange mounted to the end of the drum. Here, the similar supporting manner may be used with the use of the mounting member 15. However, in the case of this end, the provision of the plastic material cylindrical member 15*e* is not inevitable.

(Sealing member for toner container)

Figure 7:
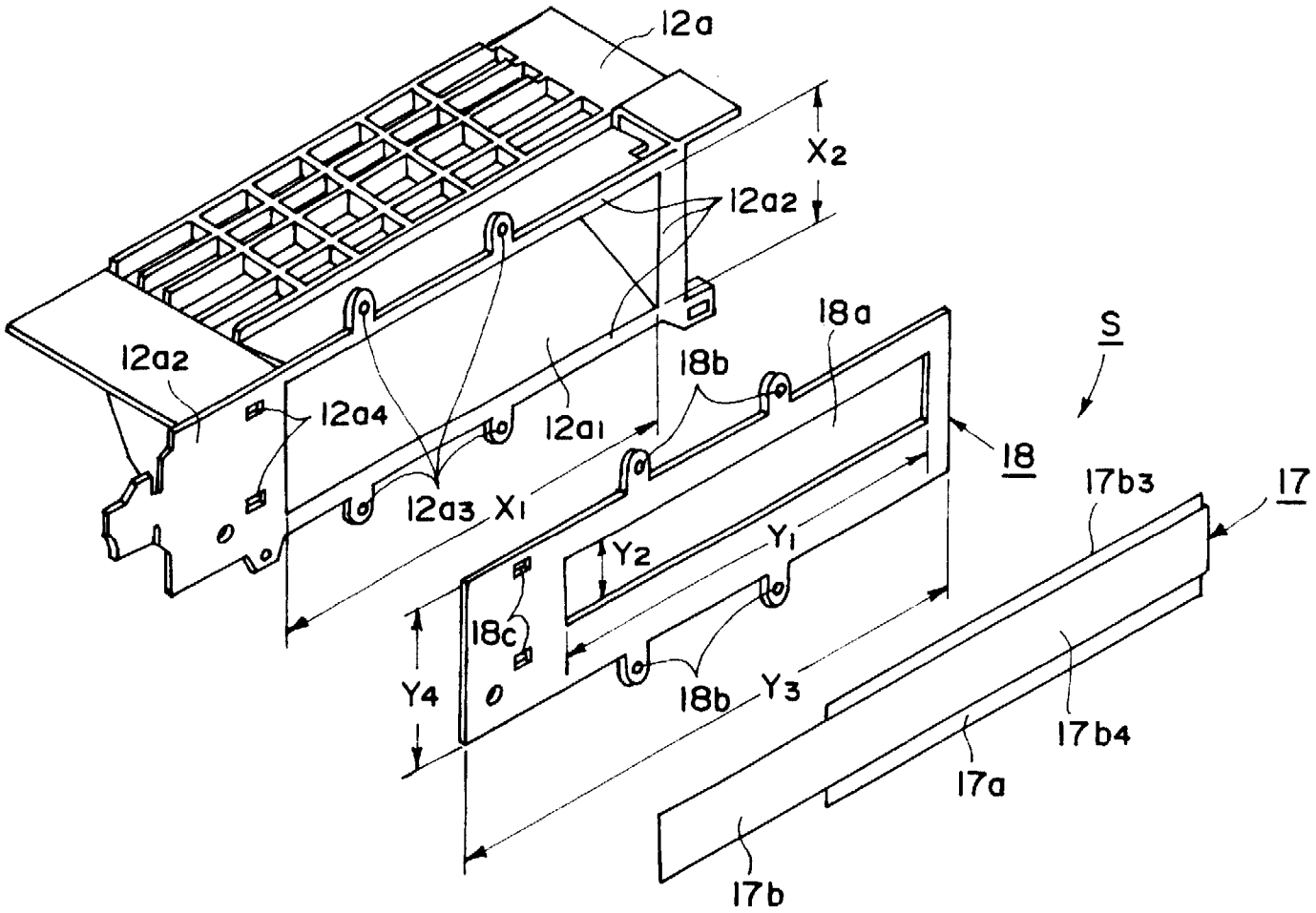
FIG. 7 is a perspective view wherein a toner container, an opening regulating member and a cover member are diassembled.

The sealing member mounted to the toner container 12*a* will be described. As shown in FIG. 7, the toner container 12*a* is provided with an opening 12*a*1 and the toner contained in the container is supplied to a developing sleeve through the opening. However, when the process cartridge B is not used, the toner in the container may leak out or may be wetted during storage or transportation of the process cartridge B, if the opening 12*a*1 is open. A sealing member S is mounted to close the opening for the purpose of hermetically closing the opening 12*a*1 before use and permitting opening thereof upon use thereof.

The sealing member S comprises a cover seal 17*a* and a flexible tear tape 17*b* made integral by fusing or the like, to constitute a cover member 17. The cover member 17 is mounted to the opening limiting member 18 by fusing or the like. The limiting member 18 is mounted adjacent the opening 12*a*1 of the toner container 12*a*, by which the opening 12*a*1 is hermetically closed.

(Cover seal)

Figure 8A:
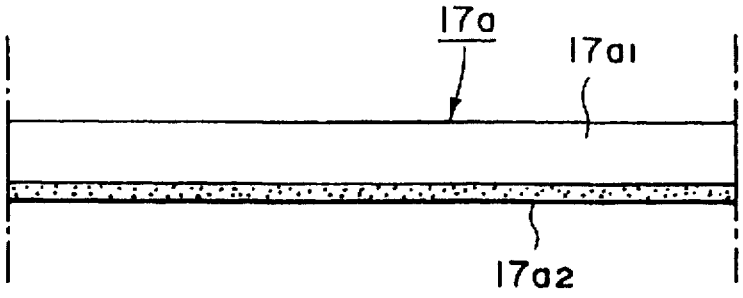
FIG. 8A is a sectional view of a cover seal.

As shown in FIG. 8A, the cover seal 17*a* comprises a base material 17*a*1 and a sealant layer 17*a*2.

The material of the base member 17*a*1 is such as to permit sufficient maintenance of sealing property of the opening of the container and to exhibit one directional tearing tendency. Examples include uniaxial oriented film material or sheet, such as uniaxial oriented polyethylene, uniaxial oriented polypropylene, uniaxial oriented foamed polypropylene materials or the like.

By the use of such a film, the force required for tearing the cover sheet 17 can be reduced, and in addition, the width of the toner opening provided by the tearing can be made uniform.

As for the base material 17*a* exhibiting a stable longitudinal tearing property and exhibiting a substantial film strength, there is drawn foamed polypropylene film or the like having a film thickness of approx. 120–140 μm, an average density of 0.6 g/cc–0.9 g/cc approx., preferably. The sealant layer 17*a*2 is preferably polyethylene sealant to permit easy fusing onto the sealant layer of the tear tape 17*b* which will be described hereinafter, by heat seal (heat fusing). Other examples include vinylacetate resin, ionomer resin. Additionally, impulse sealing or high frequency welding are usable when proper materials are selected. When a polyethylene sealant containing several percent—several tens percent of ethylene-vinyl acetate copolymer material is used, the film thickness is preferably 10–30 μm in consideration of the bonding strength, further preferably, the film thickness is approx. 15–25 μm.

(Tear tape)

Figure 8B:
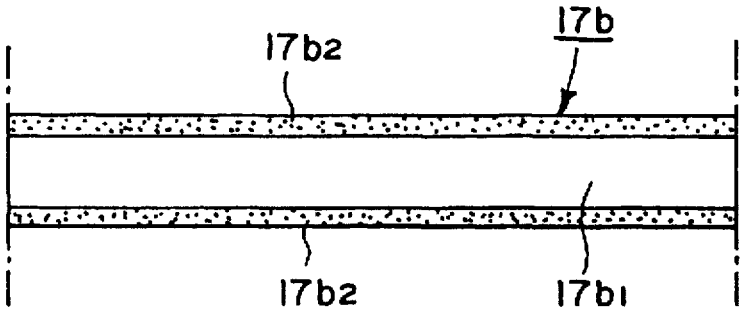
FIG. 8B is a sectional view of a tear tape.

The tear tape 17*b*, as shown in FIG. 8B, comprises a base material 17*b*1 and a sealant layer 17*b*2 at each of the front and back sides.

The material of the base member 17*b*1 is required to have sufficient strength to permit tearing of the cover seal 17*a*, more particularly, the tensile strength thereof is preferably approx. three times that of the cover seal 17*a*. Examples of usable materials include biaxial oriented polyester, biaxial oriented polypropylene, polystyrene, biaxial oriented nylon or another film or sheet material. Particularly, biaxial oriented polyester film having a film thickness of approx. 20–40 μm is preferable.

The material of the sealant layer 17*b*2 is similar to that of the sealant layer 17*a*2 of the cover seal 17*a*. When the sealant layers 17*a*2 and 17*b*2 are heat-fused for the purpose of unifying the cover seal 17*a* and the tear tape 17*b*, they are of similar materials for better fusing together therebetween. When the sealant layer 17*b*2 is of polyethylene sealant containing several—several tens percent of ethylene-vinyl acetate copolymer, is used, it has preferably a film thickness of approx. 20–40 μm in consideration of the bonding strength. Further preferably, the film thickness is approx. 25–35 μm.

Figure 9:
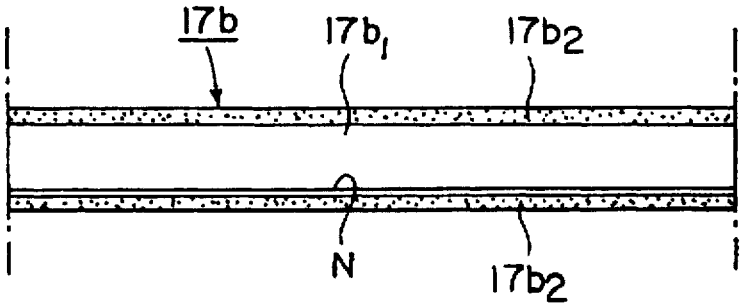
FIG. 9 illustrates a tear tape according to a further embodiment.

As for the tear tape 17*b*, as shown in FIG. 9, a nylon layer N may be provided to provide a cushion property upon the heat sealing between the base material 17*b*1 and the sealant layer 17*b*2. The nylon layer N preferably has a film thickness of approx. 10–20 μm, and further preferably approx. 13–17 μm.

Figure 10:
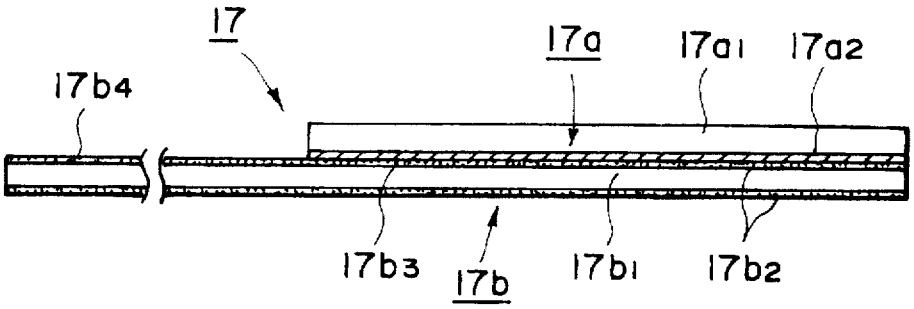
FIG. 10 is a sectional view of a cover member having an integral cover seal and a tear tape.

In this embodiment, the cover seal 17*a* and the tear tape 17*b* shown in FIG. 8, are made integral by heat-sealing, as shown in FIG. 10, to constitute a cover member 17. At this time, one longitudinal end of the tear tape 17*b* is extended out of a cover seal 17*a* and constitutes a free end. The free end portion functions as a grip for pulling the cover seal 17*a* out.

Figure 11:
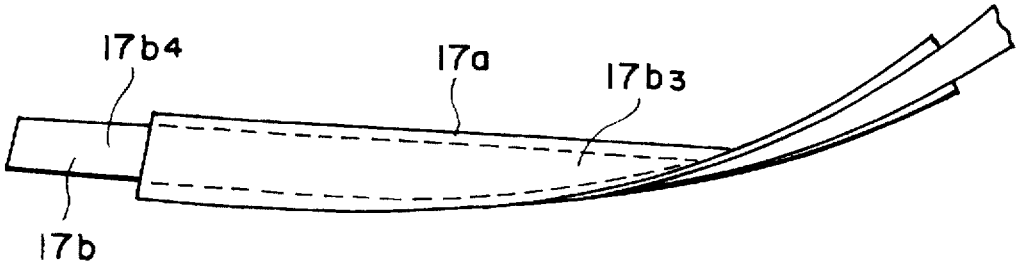
FIG. 11 illustrates a covering member which is curled.

If the thermal contraction of the base material 17*a*1 of the cover seal 17*a* is high upon the heat-fusing between the cover seal 17*a* and the tear tape 17*b*, the cover member 17 may curl as shown in FIG. 11 by the heat-pressing. If this occurs, the cover member 17 is unable to be correctly mounted to the opening limiting member 18. In order to suppress the amount of curl, the heat-contraction ratio of the base material 17*a*1 of the cover seal 17*a* is approx. 1–10 in the drawing direction, and approx. 0.1–3% in the non-drawing direction, preferably.

The heat-contraction ratio is measured when the covering member 17 is placed in a gear type hot wind oven at 120° C. for 15 min.

(Opening limiting member)

The covering member 17 is mounted to the opening portion of the opening limiting member 18 shown in FIG. 7. The opening limiting member 18 is effective to limit the width of the opening when the toner is supplied from the toner container 12*a* to the developing sleeve 10*d*. The opening limiting member 18 has a thickness of 0.3–2 mm and is of polyester plate, polystyrene plate, nylon plate, ABS plate or the like formed into a sheet. The opening 18*a* is formed by punching or molding. The opening limiting member 18 is mounted to the flange 12*a*2 around the opening 12*a*1 of the toner container by ultrasonic wave fusing or the like, and therefore, it is preferably of the same material as the container 12*a*. Therefore, if the container 12*a* is of polystyrene material, the opening limiting member 18 is also of polystyrene material.

Figure 12:
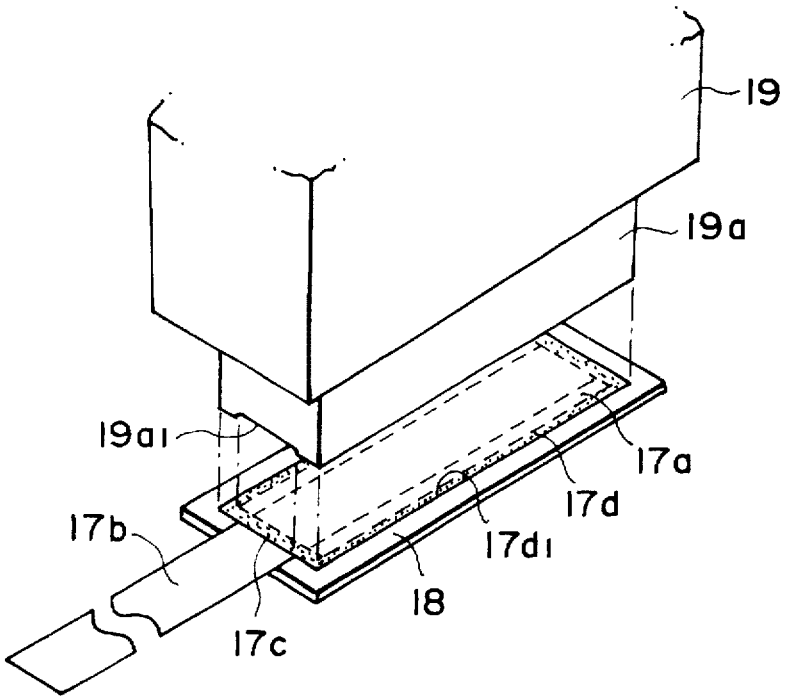
FIG. 12 illustrates fusing of a cover member to an opening regulating member.

The above-described cover member 17 is mounted to cover the opening 18*a* of the opening limiting member 18 by fusing or the like to hermetically close the opening 18*a*. As shown in FIG. 12, when the sealing is effected by the heat-press-contact, corona discharge treatment or the like is carried out for easy bonding, as desired.

As for the sealing condition, the sealing is effected with a seal bar 19*a* of a horn 19 at approx. 110° C.–130° C., a pressure of approx. 1.5 kgf/cm$^2$–5 kgf/cm$^2$ for approx. 1–3 sec. In this case, the short side overlapped portion 17*c* where the cover seal 17*a* and the tear tape 17*b* of the covering member 17 are overlapped, has a thickness larger by the thickness of the tear tape 17*b*, and therefore, a recess 19*a*1 is formed corresponding to the thickness at a portion corresponding to the seal bar 19*a*. When the thermocompression bonding is effected using seal bar 19*a*, the opening limiting member 18 and the seal bar 19*a* are maintained in parallel with each other and are uniformly press-contacted. If this is not uniform, the sealing surface 17*d* of the cover member 17 is subjected to an additional stress to such an extent that when the process cartridge B is impacted or let fall, the film is torn from an inside edge 17*d*1 of the sealing surface 17*d* with the possible result that the toner leaks out of the toner container 12*a*.

Figure 13:
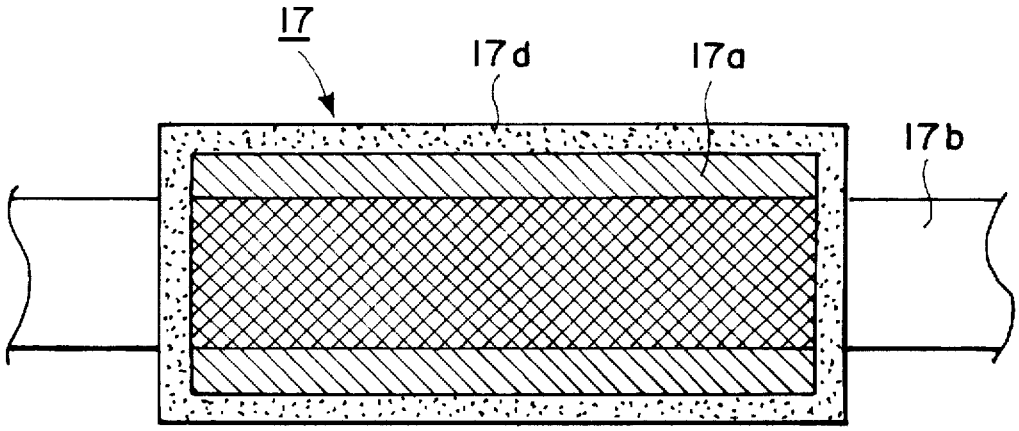
FIG. 13 illustrates a ratio of the cover seal and the tear tape.

As shown in FIG. 13, an area of overlap (hatched portion) between the cover seal 17*a* and the tear tape 17*b* excluding the sealing surface 17*d* of the cover seal 17*a* for sealing the opening 18*a* (dot portion in FIG. 13), is preferably approx. 50–99%, further preferably approx. 70–90%. The reason is that the load at the edge portion covered only by the cover seal 17*a* is reduced with increase of the area where the cover seal 17*a* and the tear tape 17*b* are overlapped, against the inside pressure by the toner in the toner container, during the transportation. Therefore, the toner leakage due to the tearing of the seal can be assuredly prevented.

In order to effectively prevent the removal of the seal, the short side length of the tear tape 17*b* is preferably larger by 0.5–2 mm approx. than the short side length of the opening 18*a* of the opening limiting member 18, since then the pressure directly applied to the sealing surface 17*d* of the cover seal 17*a* due to the falling or pressure change or the like during transportation is reduced.

(Sizes of cover seal and the like)

The dimensions of various members constituting the sealing member S are as follows (FIG. 7).

A longitudinal length of the cover seal 17*a*: approx. 237 mm.

A short side length of the cover seal 17*a*: approx. 51.5 mm.

Longitudinal length of the tear tape 17b: approx. 574 mm

Short side length of tear tape 17b: 38.5.

Longitudinal length Y1 of the opening 18a of the opening limiting member 18: approx. 220 mm.

Short side length Y2 of the opening 18a of the opening limiting member 18: approx. 36.5 mm.

Longitudinal length Y3 of the opening limiting member: approx. 278.5 mm.

Short side length Y4 of the opening limiting member 18: approx. 77.5 mm.

Longitudinal length X1 of an opening 12a1 of the toner container 12a: approx. 221.5 mm.

Short side length X2 of opening 12a1 of the toner container 12a: approx. 63.5 mm.

(Mounting of sealing member)

The opening limiting member 18 to which the cover member 17 is used, is mounted to the flange 12a2 of the toner container 12a, by which the toner container 12a is hermetically closed. Upon this mounting, the toner feeding member 10b is built in the toner container 12a, and then, the mounting is carried out. As shown in FIG. 7, an unshown tool is inserted through a positioning hole 18b at an end of a short side of the opening limiting member 18 and a positioning hole 12a3 of the toner container 12a to align the holes, and the opening limiting member 18 is positioned relative to the flange 12a2. With the positioned state, ultrasonic wave fusing or the like is carried out to complete the fusing.

Figure 14:
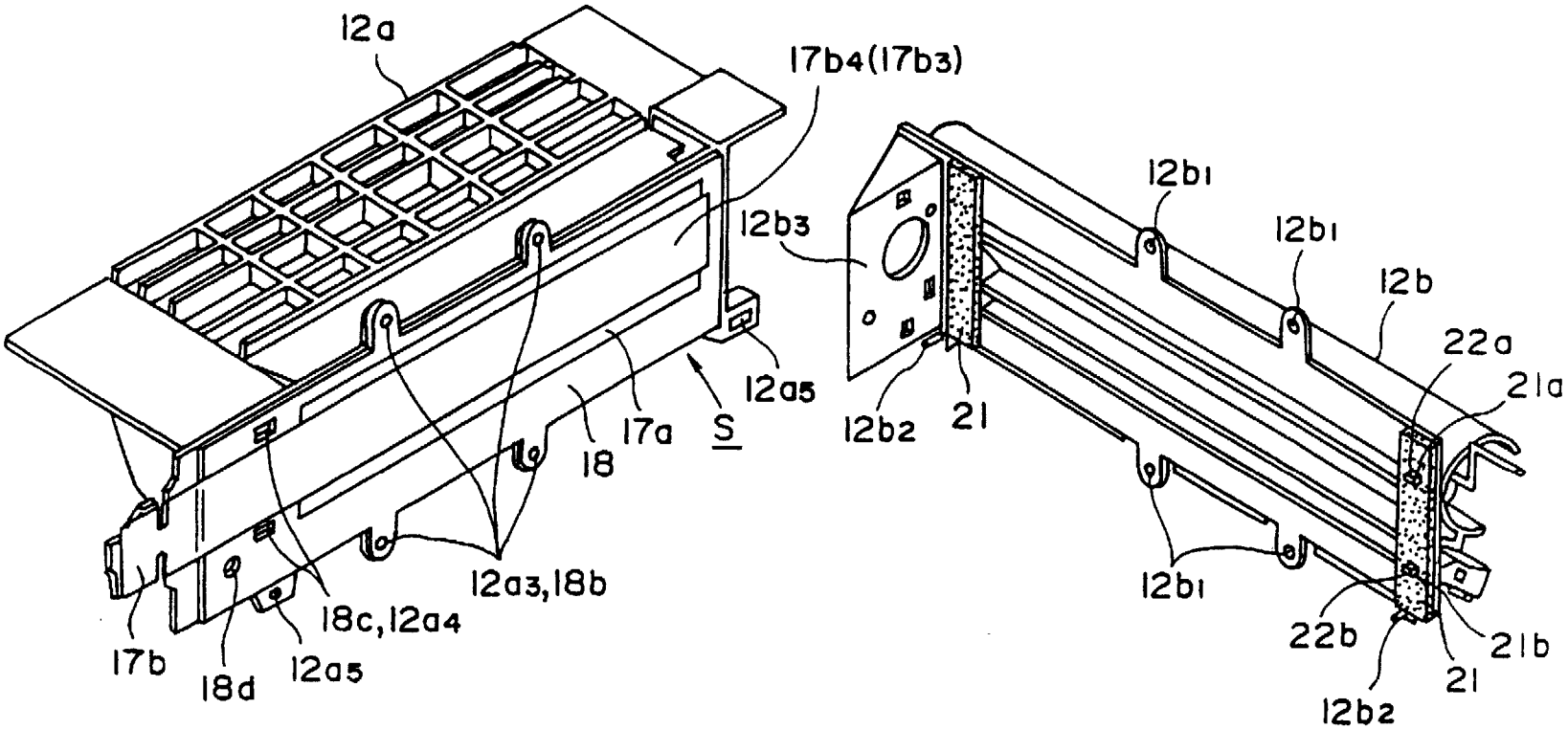
FIG. 14 illustrates mounting of a developing frame to a toner container with a sealing member.

Subsequently, a developing device frame 12b show in FIG. 14 is coupled with the toner container 12a. The developing sleeve 10d and developer blade 10e are mounted to the developing frame 12b. The positioning hole 12a3 of the toner container 12a having the sealing member S mounted thereto and in which the tear tape 17b is reversed, and the positioning hole 12b1 formed in the developing device frame 12b are inserted by an unshown tool to align the holes to correctly position the developing device frame 12b to the container 12a. With this positioned state, the ultrasonic wave fusing or the like is carried out to fuse the frame 12b to the opening limiting member 18, thus unifying the frame 12b, the sealing member S and the toner container 12a. As shown in FIG. 14, the tear tape 17b is reversed. More particularly, the tear tape 17b has a first portion 17b3 extended along one surface of a cover seal 17a and a second portion 17b4 disposed at the other side of the cover seal 17, extended from an end of the first portion 17b3 in a reverse direction.

In order to accomplish the positioning between the toner container 12a and the frame 12b, as shown in FIG. 14, positioning bosses 12b2 are provided at both sides of the frame 12b. The toner container 12a is provided with holes 12a5 engaged by the bosses 12b2. In FIG. 14, a wall 12b3 is provided at one longitudinal end of the frame 12b for mounting a driving unit for driving the toner feeding member or the like. Designated by reference 18d is a positioning hole effective when the opening limiting member 18 is mounted to the toner container 12a. A tab having positioning holes 12a3, 12b1 and 18b usable for the positioning of the developing frame 12b or the like, becomes unnecessary when the three parts are integrated, and therefore the tab is removed thereafter.

Figure 15:
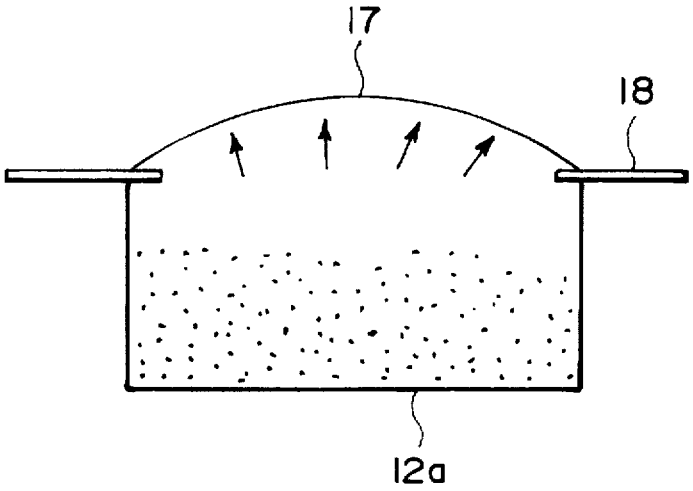
FIG. 15 illustrates pressure applied to the cover seal by an internal pressure of the toner container.
Figure 16:
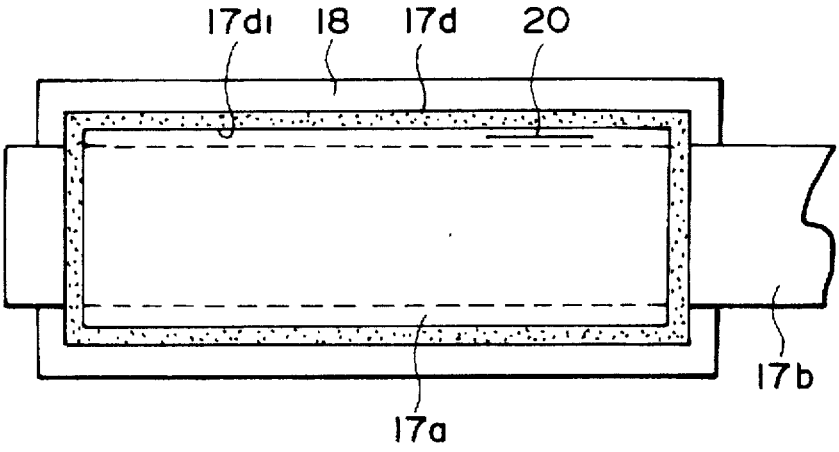
FIG. 16 illustrates a torn cover seal.
Figure 17:
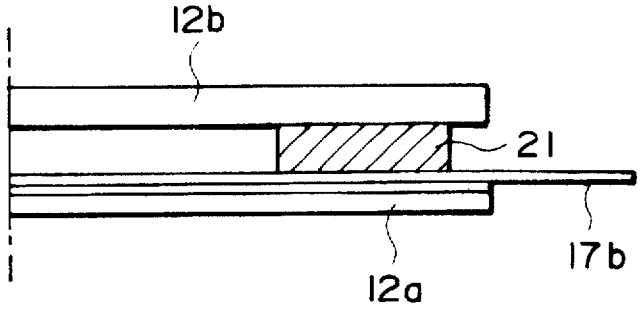
FIG. 17 is a sectional view of an example having an end seal.

In this manner, the toner is supplied through an inlet port not shown into the toner container 12a mounted to the developing frame 12b, and the port is closed. Then, the photosensitive drum 7 is assembled thereinto thus constituting the process cartridge B. Then, the process cartridge B is delivered from the plant. During the transportation, as shown in FIG. 15, the cover member 17 is subjected to load due to falling, impact or pressure change experienced by the cartridge. Then, there is a liability that the inside edge 17d1 portion of the sealing surface 17d is torn (20), as shown in FIG. 16. This is because, the cover seal 17a is a uniaxial oriented material, and therefore, the direction of the stress upon the thermocompression using the seal bar 19a is aligned with the longitudinal tearing direction, and therefore, it is relatively easily torn as contrasted to the non-drawn direction.

To avoid the liability, the durability against the tearing of the base material 17a1 of the cover seal 17a is important. It is preferably approx. 1.0–3.0 kgf/mm in the non-drawing direction, further preferably it is 1.3–3.0 kgf/mm. The film thickness of the base material 17a1 of the cover seal 17a is preferably approx. 130–150 μm.

With the above-described process cartridge B, the tear tape 17b is pulled out so that the cover seal 17a is torn, by which the sealing member S is opened, before the use thereof. In order to prevent the toner leakage between the toner container 12a and the developing device frame 12b, adjacent the longitudinal ends of the developing frame 12b, end seals 21 of foamed polyurethane material or the like are bonded to the backside of the developing device frame 12b.

The end seal 21 has usually a thickness of approx. 2–5 mm, and after the coupling between the frame 12b and the toner container 12a, it is compressed to a thickness of approx. one half or one third, so that the toner leakage after the opening is prevented.

However, the force required for pulling the tear tape 17 upon the start of the use is increased by the end seal 21, and in addition, the torn end of the cover seal 17a becomes fuzzy or non-smooth because of the friction with the end seal 21. The reason for this is as follows. If the fusing between the sealant layer 17a2 of the cover seal 17a and the sealant layer 17b of the tear tape 17b is not complete, the cover seal 17a is torn approx. 2–3 mm larger in width than the tearing width of the tear tape 17b. This is the reason for the fuzziness. Therefore, the material of the sealant layer 17a2 of the cover seal 17a is the same as or similar to that of the sealant layer 17b2 of the tear tape 17b.

If the pulling direction of the tear tape 17 is improper when the tear tape 17b is pulled by a user prior to the start of the use of the process cartridge, and pulling force is significantly increased even to the worst extent that the tear tape 17b becomes unable to be pulled out.

Figure 18:
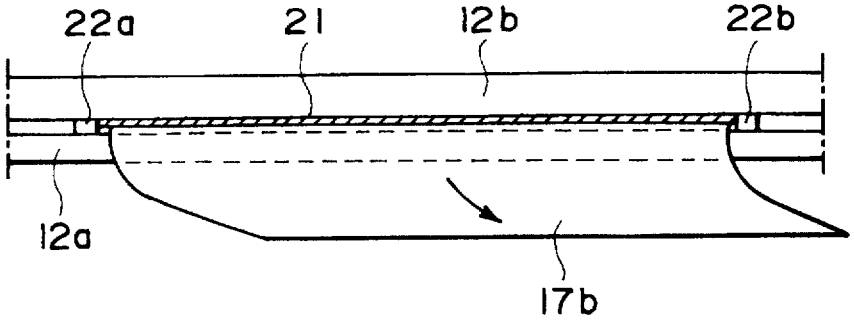
FIG. 18 is illustrates a limiting boss for limiting pulling of the tear tape.

In view of this, in this embodiment, as shown in FIGS. 14 and 18, bosses 22a and 22b functioning as regulating members for the pulling are provided with a space slightly larger than the width of the tear tape 17b. The bosses 22a and 22b are inserted into holes 18c and 12a4 formed in the opening limiting member 18 and the toner container 12a, when the frame 12b and the toner container 12a are coupled. In this embodiment, the space between the bosses 22a and 22b is approx. 41.5 mm and are placed at. approx. 1–3 mm away from lateral ends of the tear tape 17b, respectively. As will be clear from FIGS. 14 and 34, the end seal 21 is provided with holes 21a and 21b, and the bosses 22a and 22b are engaged with the holes 21a and 21b.

By the provision of the bosses 22a and 22b, as shown in FIG. 18, even if the operator erroneously pulls the tear tape 17b in an inclined direction, the bosses 22a and 22b function as guiding the lateral ends of the tear tape 17b to permit smooth pulling in the opening direction. If the tear tape 17b is inclinedly pulled, the friction resistance is imparted between the tape 17b and the bosses 22a and 22b, and therefore, the user will be notified of the wrong direction pulling of the tear tape 17b.

In this embodiment, the bosses 22a and 22b are provided on the frame 12b, and the holes 12a4 are formed in the toner container 12b. Conversely however, the toner container 12a may be provided with bosses, and the frame 12b is provided with holes engaged thereby, with the same advantageous effects.

(Results of experiments)

The results of experiments as to the strength against pulling or the like after producing various cover seal and tear tapes, will be described.

(Experiment 1)

Two kinds of cover seals 17a are prepared. The base materials 17a1 are 120 and 140 μm thick, respectively. They are coated with sealant layer 17a2 of ethylene-vinyl acetate (EVA) of the same material having a thickness of 20 μm, by dry lamination. As shown in FIG. 10, they are heat-sealed with the tear tape 17b, thus producing two kinds of covering members 17.

The tear tape 17b comprises a base material 17b1 of biaxial oriented polyester film having a thickness of 38 μm, a sealant layer 17b2 (EVA) having a thickness of 30 μm, and a drawn nylon layer N having a thickness of 15 μm as a cushion layer.

The heat seal conditions are 115° C., 2.8 kg/cm$^2$ and 3 sec. The size of the cover seal 17a is 48.0×237 mm, and the size of the tear tape 17b is 37.5×575 mm.

The cover members 17 for each of the two kinds of toner containers 12a are heat-seal mounted on a seal surface of the opening limiting member 18 of polystyrene plate having an opening 18a of 36.5 mm×220 mm and a thickness of 0.5 mm, after corona discharge treatment. Thus, the sealing member S of the toner container 12a is produced. The heat seal conditions are 140° C., 3.0 kg/cm$^2$, 5.5 sec. It has been confirmed that the parallelism between the seal bar 19a and the seal surface of the opening limiting member 18 is correctly maintained, and thereafter, the heat sealing is carried out.

Thereafter, the opening limiting member 18 having the cover member 17 is fused to the flange 12a2 of the toner container 12a by ultrasonic wave. In this manner, two kinds of toner containers 12a are manufactured. These are called Example 1 and Example 2.

As a Comparison Example, in place of the cover seal 17, the use is made of a conventional easy peel film, and the opening limiting member 18 is sealed thereby. Then, the opening limiting member 18 is securedly fixed by ultrasonic wave fusing. In this manner, a toner container of Comparison Example 1 was manufactured. The easy peel film comprises a first base material having a thickness of 16 μm, a second base material having a thickness of 25 μm, a cushion layer having a thickness of 20 μm, and an EVP sealant layer having a thickness of 30 μm. The first base material and the second base materials are of polyethylene terephthalate and the cushion layer is of low molecular weight polyethylene having an average molecular weight of approx. 10,000.

With respect to the three toner containers, the force required for pulling the tear tape, that is, the strength against the pulling, in the direction of 180° C. has been measured. The drawing speed is approx 3000 mm/min.

As will be understood from FIG. 19, the pulling force is small in Examples 1 and 2, and it is quite high in Comparison Example 1.

Additionally, each of the three toner containers is coupled with a developing device frame 12b provided with pulling direction limiting bosses 22a and 22b, by ultrasonic wave fusing, so that three process cartridges are manufactured.

An end seal 21 of foamed polyurethane material is set in the process cartridge after it is opened. By this, the toner leakage from the process cartridge after it is opened is prevented upon, for example, the cartridge is taken out upon occurrence of troubles such as paper jam or the like. In view of the balance with this effect and the pulling force, the thickness thereof is 3 mm.

FIG. 20 shows the results at the pulling speed of approx. 3000 mm/min, for the respective process cartridges.

As will be understood from FIG. 20, the required force is very low in Examples 1 and 2, and therefore, the operativity is good. On the other hand, in the case of the process cartridge of Comparison Example 1 using the easy peel film exhibited very high force required, and therefore, the operativity is poor even to such an extent that a user is unable to open it.

(Experiment 2)

The Examples 1 and 2 are used with modifications that the size of the opening is 60 mm×220 mm, the size of the cover seal 17a is 71.5 mm×237 mm, and the size of the tear tape 17b is 61.5 mm×575 mm. Similarly to Experiment 1, the toner containers 12a and the process cartridges B are manufactured. They are called Example 3 and Example 4, respectively.

As a Comparison Example 2, in place of the covering member 17, the easy peel film used in Comparison Example 1 is used with size change to match the size of the opening of the opening limiting member 18. In the similar manner, the toner container and process cartridge are manufactured.

Using the three kinds of toner accommodating containers and process cartridges, the pulling force test and pressure durability test are carried out, and after 550 g of toner is loaded, the falling test is carried out. FIGS. 21 and 22 show the results.

In the pressure durability test, the conditions are as follows. The pressure is increased at each 0.05 kgf/cm$^2$ with 5 sec. maintenance of the pressure, and the test is continued until the cover member is punctured by the internal pressure. The conditions of the falling tests are as follows. Three are let fall from the height of 60 cm in two modes, i.e., 1-corner 3-edge and 6-side mode and 6-side 4-corner mode. For one lot, 10 falling tests are carried out, and the toner leakage from the covering member is checked.

As will be understood from FIGS. 21 and 22, recording the tear tape pulling strength and the opening strength, the Examples 3 and 4 are satisfactory, and there arises no problem even if the width of the opening 18a of the opening limiting member 18 is increased to 60 mm approx. However, as to the Comparison Example 2, the operativity of the tear tape is very poor so that an ordinary user is unable to open it.

As regards pressure durability and falling tests, the pressure durability is high enough in Examples 3 and 4, and no problem arises in the falling test. With the Comparison Example 2, the bonding strength of the seal is not enough with the result of toner leakage when the width of the opening 18a is increased as in this case.

As regards Examples 3 and 4, as will be apparent from the foregoing results, the sealing property of the cover seal 17a is good enough, and the tear tape 17b has a width larger than the opening width of the limiting member 18, and therefore, the pressure directly applied to the sealing surface of the cover seal 17*a* is reduced, that is, there are significant advantageous effects from the standpoint of pressure durability, falling or other transportation ambience.

(Experiment 3)

This is a modification of Examples 3 and 4. The size of the opening of the limiting member 18 is 60 mm×220 mm, and the size of the cover seal 17*a* is 71.5 mm×237 mm, as in Examples 3 and 4. The size of the tear tape 17*b* is 37.5 mm×575 mm. Similarly to Examples 3 and 4, the toner containers and the process cartridges are manufactured. They are called Examples 5 and 6, respectively.

The experiments have been carried out to check whether the opening width can be assuredly limited by the tear tape 17*b*, when the opening width of the limiting member 18 is larger than the opening width of the developing device.

The tear tape is pulled at a speed of approx. 3000 mm/min, and the tearing expansion of the cover seal 17*a* after the opening, the fuzziness at the end surface of the cover seal 17*a* upon the opening, that is, the stability of the tearing, are checked. The results are shown in FIG. 23.

As will be understood from FIG. 23, the tearing expansion of the cover seal 17*a* upon the opening is not more than 1 mm for both of them, and therefore, the opening width to the developing device is sufficiently limited, and the tearing stability is satisfactory.

The process cartridge is set in the main assembly of the apparatus, and the influence to the image is checked, and it has been confirmed that the toner discharging property is very good without any problem on the image.

From the foregoing, it has been confirmed that even when the opening width of the limiting member 18 is larger than the opening width of the developing device, the width of the opening of the developing device frame to the developing device is assuredly limited by the tear tape 17*b*.

When the conventional easy peel film is used, the opening width to the developing device can not be limited by the sealing member.

(Experiment 4)

For each of three kinds of process cartridges manufactured in accordance with Examples 1 and 2 and Comparison Example 1, 100 process cartridges are manufactured. The tear tape is pulled at a pulling speed of approx. 3000 mm/sec, and the process cartridge is disassembled after the opening, and the seal surface on the limiting member 18 is checked as to whether the residual sealant remains or not.

The opened process cartridge is set in the main apparatus, and it has been checked whether improper image formation with white stripes or the like occurs by introduction of the residual sealant into the toner or not. The results are shown in FIG. 24.

As will be understood from FIG. 24, no residual sealant or no improper image formation is observed with respect to Examples 1 and 2, but in Comparison Example 1, 5 cartridges out of 100 cartridges involved the residual sealant. Among five cartridges, the improper image formation caused thereby occurs in 3 process cartridges.

Referring to FIGS. 25–44, further embodiments will be described. First a seal pattern will be described.

Figure 25:
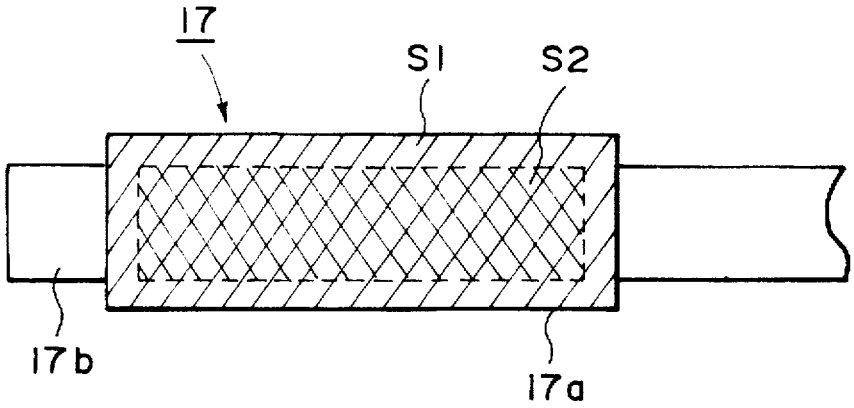
FIG. 25 illustrates a conventional sealing member in which a cover film and a tear tape are entirely heat-sealed.

When the cover film 17*a* and the tear tape 17*b* are unified, the entirety of the overlapped portion between the cover film 17*a* and the tear tape 17*b* (cross-hatched portion) S2 is sealed except for the sealing portion (hatched portion) S1 corresponding to the opening portion of the sealing member 17, in a conventional example, as shown in FIG. 25. However, since the thermal contraction ratio of the film materials of the cover film 17*a* and the tear tape 17*b* are different, the sealing member 17, after the sealing, may be significantly curled in the longitudinal direction and the width direction, as shown in FIG. 11.

Figure 26:
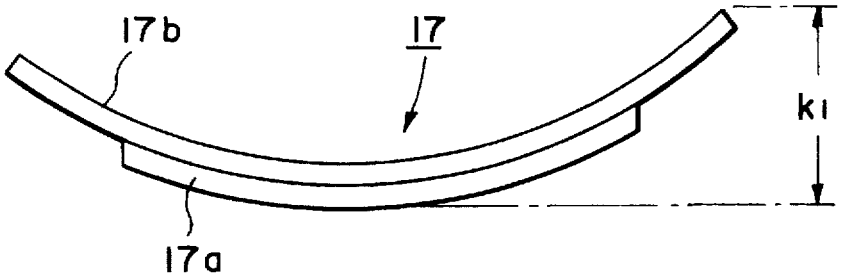
FIG. 26 illustrates curling of the sealing member.

As shown in FIG. 26, if the curling amount, particularly that in the width direction K1 is 2–3 mm approx., there arises no problem, however, if it is several tens mm, the next step for positioning the sealing member 17 against the opening in the sealing operation becomes difficult with the possible result of deviation.

Figure 27:
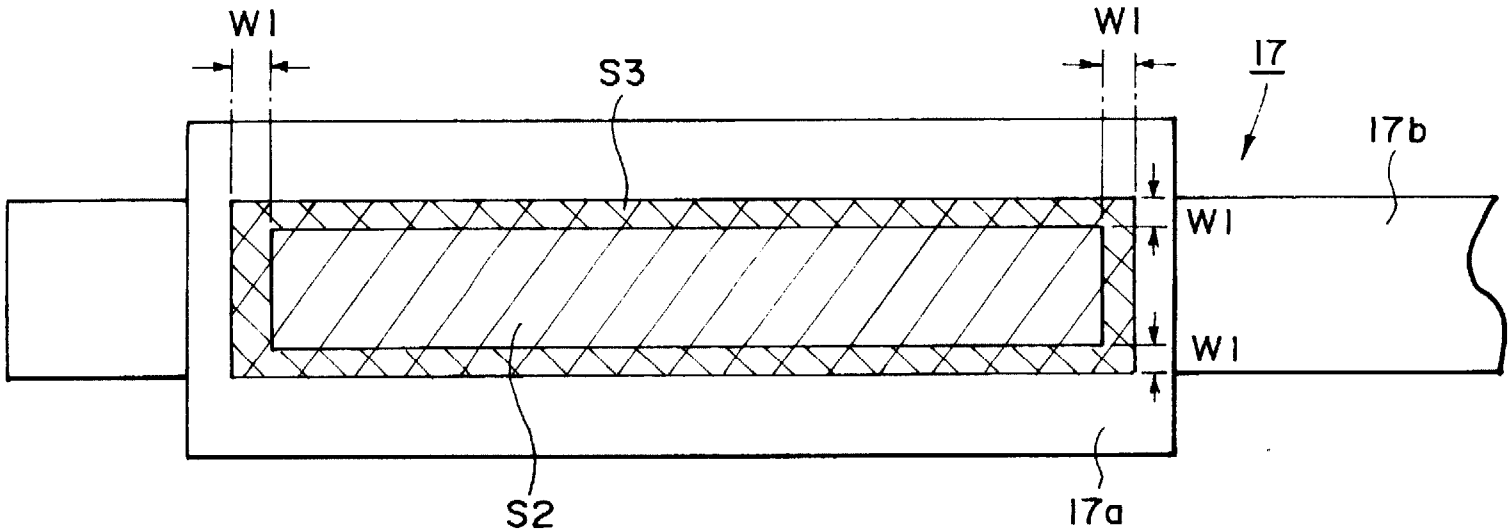
FIG. 27 illustrates a sealing member in which a cover film and a tear tape are heat-sealed at overlapped marginal regions.

It has been found as a result of investigations and experiments, as shown in FIG. 27, if a seal pattern S3 portion which is an outer periphery of the conventional sealing portion S2 is sealed, it is possible to manufacture the sealing member 17 substantially without the curling, without damaging the peeling property.

The sealing width W1 of the seal pattern S3 is preferably approx. 2–7 mm. Particularly as regards the two short sides of the seal pattern S3, if the peeling seal member 17 is assuredly unified, the tearing property is deteriorated even to the worse extent that the cover film 17*a* becomes fuzzy after removal. Particularly, therefore, in the case of the toner container having an opening width not less than 20 mm, the sealing width W1 of the two short sides size is preferably approx. 5–7 mm.

Figure 28:
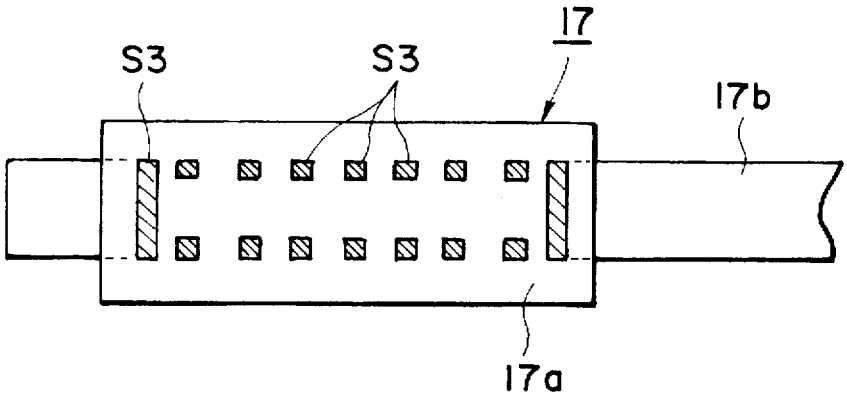
FIG. 28 illustrates a sealing member in which a cover film and a tear tape are heat-sealed at spots in a longitudinal periphery.
Figure 29:
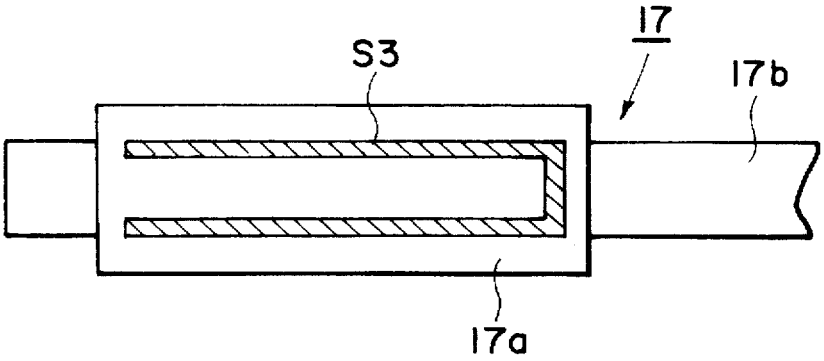
FIG. 29 illustrates a sealing member wherein the heat seal is omitted at one of a short side around the overlapped portion of the cover film and the tear tape.

As shown in FIG. 28, the seal pattern S3 may be intermittent only in the two longitudinal sides, or as shown in FIG. 29, the seal pattern S3 may not be sealed at a short side portion corresponding to an end of the tearing of the tear tape 17*b* (channel-like form).

Figure 30:
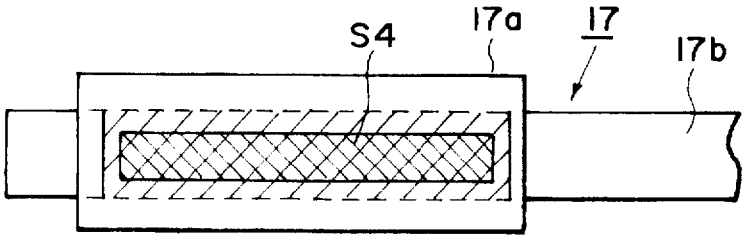
FIG. 30 illustrates a sealing member in which the heat sealing is effected only at an internal periphery of the overlapped portion between the cover film and the tear tape.

As shown in FIG. 30, sealing only an internal portion S4 (cross-hatched portion) of the conventional sealing portion (S2 in FIG. 25), is effective for curl prevention, but since the short side portion corresponding to the start of the tearing is not sealed, and therefore, the tearing property is not good with the result of production of fuzzy portion of the cover film 17*a*, and therefore, this is not preferable.

The description will be made as to the mounting of the sealing member.

(Mounting of the sealing member to the opening limiting member)

In the mounting of the sealing member 17 to the opening limiting member 18, the sealing member 17 is fused on the opening limiting member 18, thus hermetically closing the opening 18*a*.

Figure 31A:
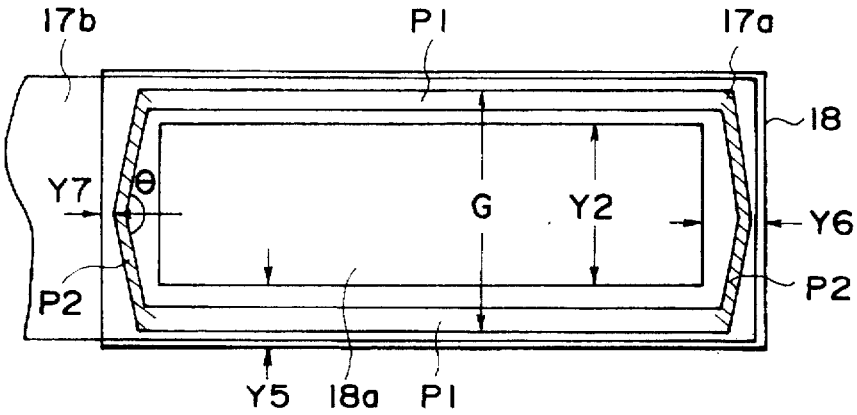
FIGS. 31A and 31B illustrate a seal pattern according to a first embodiment in which the sealing member is sealed in a mountain pattern on an opening limiting member.
Figure 31B:
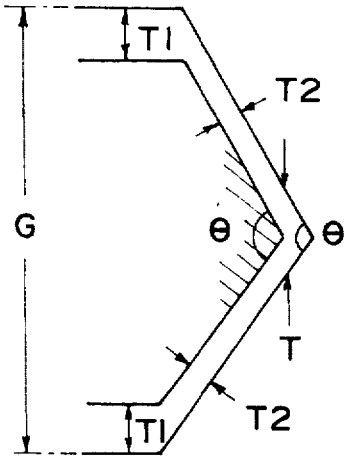

As shown in FIG. 31A, the seal pattern of the fusing is such that the portion corresponding to the leading end and the trailing end upon the pulling of the tear tape 17*b*, that is, the portion P2 (short side seal pattern) corresponding to the short side of the opening 18*a* is narrowed as much as possible relative to the portion corresponding to the middle part, that is, the portion corresponding to the longitudinal side P1 (longitudinal seal pattern), in consideration of the short side length (opening width) Y2 of the opening limiting member 18 and the toner content therein, so that the toner does not leak out of the container 12*a* by the falling, impact or the like. The short side seal pattern P2 is in the form of a mountain having an apex angle G.

The longitudinal seal pattern P1 has an outer blank or inner blank of the fusing of the sealing member 17 in consideration of the seal deviation, relative to the width Y5 of the longitudinal flange portion. The blanks are approx. 1–2 mm. The sealing width T1 of the longitudinal seal pattern is preferably approx. 2–5 mm. When the dimension of the short side of the opening 18*a* (Y1) is as large as approx. 20–100 mm, it is preferably approx. 3–5 mm.

The short side seal pattern P2 has an outer blank of fusing of the sealing member 17, that is, the difference Y7 from the distance from the longitudinal end of the opening limiting member 18, of approx. 1.0–3.0 in consideration of sealing deviation, relative to a width Y6 of the short side flange of the opening limiting member 18. The sealing width T2 is approx. 1.5–3.5 mm. If the short side length Y2 of the opening 18*a* is as long as 20 mm, the sealing width T2 is preferably approx. 2.0–3.5 mm.

As described, the sufficient durability against pressure is provided even if the sealing width T2 of the short side seal pattern P2 is narrower than the seal width T1 of the longitudinal seal pattern P1. When the same force is uniformly applied to the longitudinal and short side seal patterns P1 and P2 upon falling or impact, the seal bulges in the longitudinal direction normally since the short side length Y2 of the opening 18*a* is shorter than the longitudinal length Y1. From the standpoint of the durability against pressure, the force applied to the short side seal pattern P2 is smaller than the force applied to the longitudinal seal patter P1. Therefore, the seal pattern width T2 of the short side may be smaller than the longitudinal seal pattern width T1, and the durability against pressure is still sufficient.

When the developing device frame 12*b* is joined to the toner container 12*a* having the opening limiting member 18 mounted thereto by ultrasonic wave fusing or the like, the portion of the short side seal pattern P2 is confined by the end seal member 21 of foamed polyurethane or the like provided adjacent the frame 12*b* (FIG. 14), and therefore, the sealing width T2 (approx. 1–2 mm) narrower than the longitudinal seal pattern width T1.

The sealing member 17 fused using the seal pattern is removed by pulling the tear tape 17*b*. Upon the pulling, the maximum force felt by the user is proportional to the maximum sealing width T shown in FIG. 31B. That is, the maximum sealing width T is large, the required pulling force is large, and it is small if the maximum width is small. The maximum sealing width T when the apex angle of the mountain is used, $$T=2\times[T2/\cos(\theta/2)]. \quad (1)$$

Figure 32:
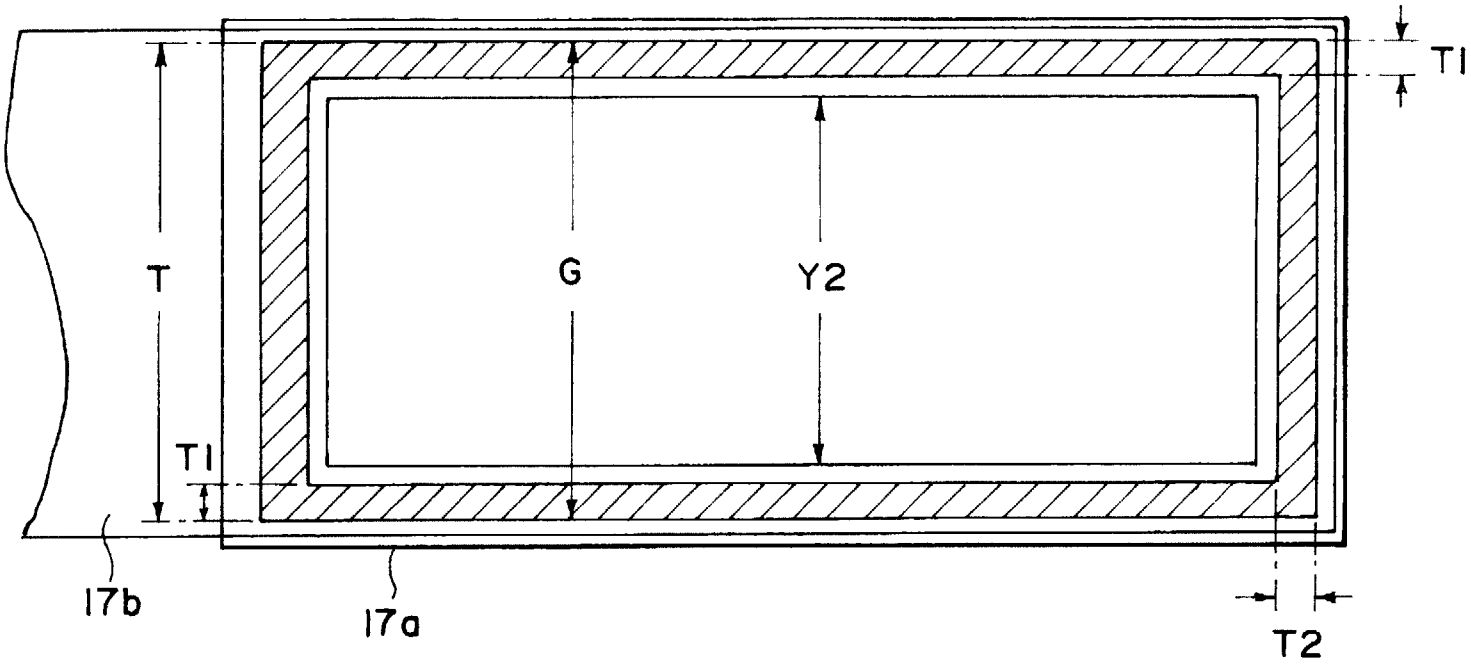
FIG. 32 illustrates a conventional seal pattern in which the sealing member is sealed in the form of a frame on the opening limiting member.

Accordingly, the opening strength (required pulling force) is proportional to the sealing width T2 of the short side seal pattern P2. If the sealing pattern is linear as in the case of frame pattern rather than the mountain pattern, the sealing width G and the maximum sealing width T are the same, as shown in FIG. 32. If the usable sealing width G in consideration of the short side length Y2 of the opening 18*a*, the opening strength becomes the maximum.

Figure 33A:
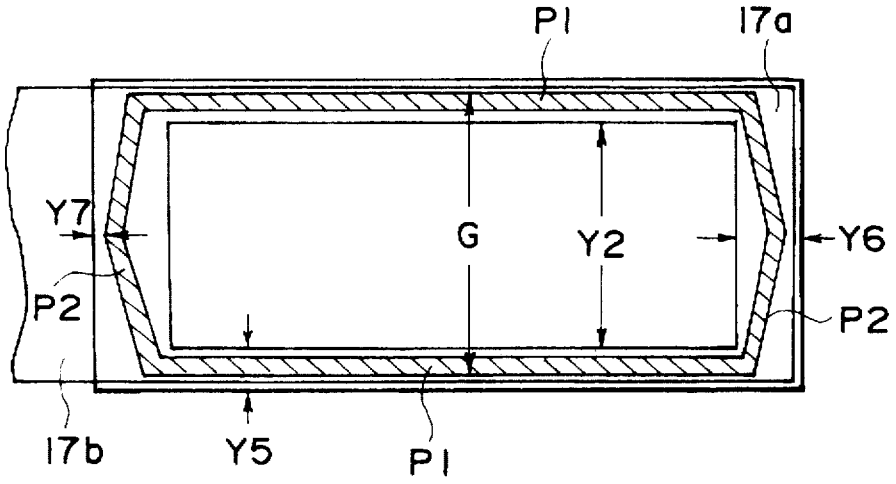
FIGS. 33A and 33B illustrate a conventional seal pattern in which a sealing member is sealed in the form of a mountain on an opening regulating member, and a seal width uniform.
Figure 33B:
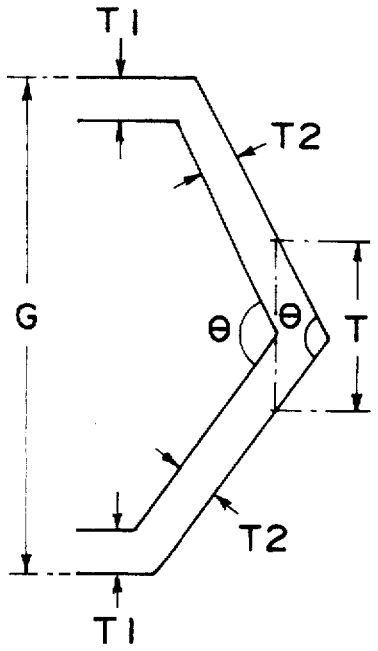

As shown in FIGS. 33A and 33B, even if the short side seal pattern P2 is mountain-like, the maximum sealing width is large as compared with the case of this embodiment (T1>T2) as will be understood from the above equation (1), if the short side seal pattern width T2 is the same as the longitudinal seal pattern width T1 (T1=T2).

Thus, the opening strength of the sealing member 17 is minimized by employing the mountain-like form in the short side seal pattern P2 and by making the seal width T2 smaller than the longitudinal seal pattern width T1, and therefore, the significant reduction of the opening strength is accomplished.

As will be understood by the equation (1), the opening strength is reduced if the apex angle θ is reduced. If, however the θ is reduced beyond 90 degrees, the toner in the toner container 12*a* may enter between the sealing member 17 and the opening limiting member 18 in the mountain portion with the result of scattering of the toner thus introduced when the sealing member 17 is removed. In addition, if the angle θ is smaller than 90 degrees, the seal may become loose at the end portion of the mountain shape (hatched portion of FIG. 31B) when the toner container 12*a* or the process cartridge B fall or is impacted, with the result of larger pressure applied, and therefore, the toner is liable to leak.

Accordingly, the short side seal pattern P2 is in the form of a mountain, but the apex angle is not less than 90 degrees, by which the toner scattering upon the opening can be reduced, and the durability against the pressure can be assured. In addition, the opening strength can be reduced. In this case, the preferable apex angle is 90–170 degrees, and further preferably 130–120 degrees. The short side width Y6 of the opening limiting member 18 is preferably 3–12 mm, and further preferably 5–12 mm.

(Dimensions of the sealing member)

The dimensions of the sealing member S in this embodiment are as follows (FIGS. 7 and 31).

Length of the cover film 17*a*: 237 mm.

Short side dimension of the cover film 17*a*: 51.5 mm.

Length of the tear tape 17*b*: approx. 574 mm.

Short side length of the tear tape 17*b*: approx. 38.5 mm.

Longitudinal dimension Y1 of the opening 18*a* of the opening limiting member 18: approx. 220 mm.

Short side dimension Y2 of the opening 18*a* of the opening limiting member 18: approx. 36.5 mm.

Longitudinal dimension Y3 of the opening limiting member 18: approx. 278.5 mm.

Short side dimension Y4 of the opening limiting member 18: approx. 77.5 mm.

Longitudinal dimension Y5 of the opening limiting member 18: approx. 15 mm.

Short side dimension Y6 of the opening limiting width 18: approx. 11 mm.

Longitudinal seal pattern width T1: approx. 3.5 mm.

Short side seal pattern width T2: approx. 2 mm.

Apex angle θ: approx. 160 deg.

Longitudinal dimension X1 of the opening 12*a*1 of the toner container 12*a*: approx. 221.5 mm.

Short side length X2 of the opening 12*a*1 of the toner container 12*a*: approx. 63.5 mm.

(Mounting of the sealing member)

Figure 34:
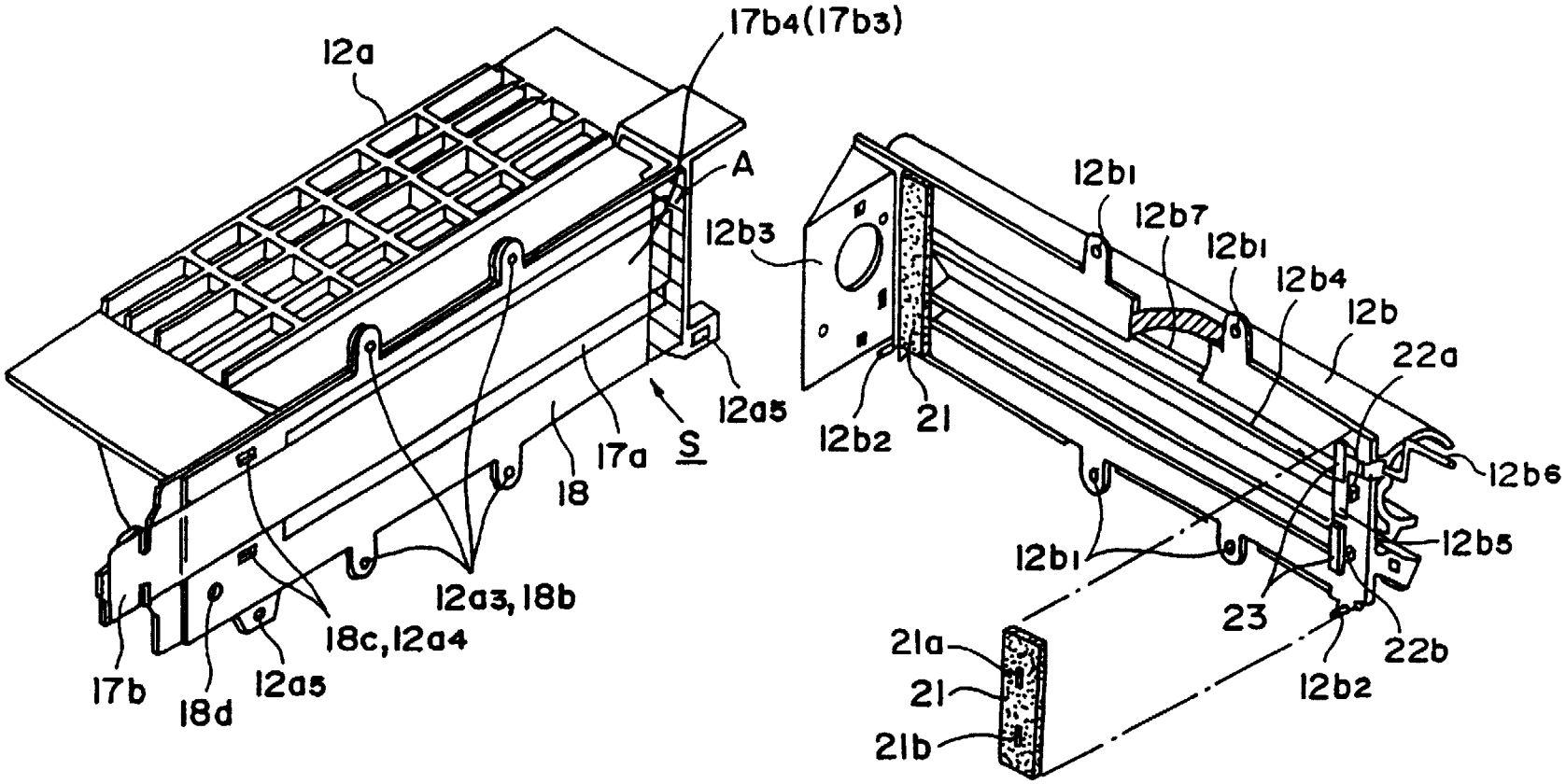
FIG. 34 illustrates a toner container having a sealing member, to which a developing frame is mounted.

The opening limiting member 18 to which the cover member 17 is fused, is mounted to the flange 12*a*2 of the toner container 12*a*, by which the toner container 12*a* is hermetically closed. Upon this mounting, the toner feeding member 10*b* is built in the toner container 12*a*, and then, the mounting is carried out. As shown in FIG. 34, an unshown tool is inserted through a positioning hole 18*b* at an end of a short side of the opening limiting member 18 and a positioning hole 12*a*3 of the toner container 12*a* to align the holes, and the opening limiting member 18 is positioned relative to the flange 12*a*2, with the positioned state, ultrasonic wave fusing or the like is carried out to complete the fusing. Thus, the toner container is assembled.

(Developing device frame)

Subsequently, a developing device frame 12*b* shown in FIG. 34 is coupled with the toner container 12*a*. The developing sleeve 10*d* and developer blade 10*e* are mounted to the developing frame 12*b* as shown in FIG. 2.

Adjacent the toner supply port of the developing blade 10*e*, an antenna line 12*b*4 functioning as an electrode for detecting the toner remaining amount change as an electrostatic capacity change is fixed.

The antenna line 12b4 is placed in a groove formed in the developing frame 12b, and a fixing member 12b5 is fixed in the groove by adhesive, and an end 12b6 is exposed to the outside as an electrode. Adjacent the antenna line, there is mounted a toner stirring rod 12b7. The stirring rod 12b7 rotatably supports an end of a wire bent to a channel shape, and driving force is transmitted to a gear (not shown) fixed to one of the ends, by which the stirring rod 12b7 is rotated to stir the toner fed to the developing sleeve 10d through the toner supply port.

The developing frame 12b is provided with members 22a, 22b or the like for limiting a pulling direction of the end sealing member 21 or a tear tape 17b, at a predetermined position.

The positioning hole 12a3 of the toner container 12a having the sealing member S mounted thereto and in which the tear tape 17b is reversed, and the positioning hole 12b1 formed in the developing device frame 12b are inserted by an unshown tool to align the holes to correctly position the developing device frame 12b to the container 12a. With this positioned state, the ultrasonic wave fusing or the like is carried out to fuse the frame 12b to the opening limiting member 18, thus unifying the frame 12b, the sealing member S and the toner container 12a. The description will be made as to the structure which is different from that in FIG. 14.

In this embodiment, when the toner container 12a and the frame 12b are coupled, the end sealing member 21, as shown in FIG. 34 by hatching lines A, pushes the longitudinal end portion of the cover film 17a and the reversed end portion of the tear tape 17. The reason is as follows.

Since the tear tape 17b is folded back (reversed), when the tape 17b (second portion, 17b4), is pulled, the cover film 17a is torn from the reversed end (tearing end), so that it is removed. At this time, the width of the tear tape 17b is small, there arises no problem. However, when the opening 18a of the limiting member 18 is a large width with the result that the width of the tear tape 17b is large, the width of overlap between the cover film 17a and the tear tape 17b in the short side seal pattern P2 (FIG. 31) increases. For this reason, when the tear tape 17b is pulled, the force required for peeling the cover film 17a off the limiting member 18 becomes larger than the force (bonding force by the short side seal pattern P2) with which the cover film 17a is bonded on the limiting member 18. In this case, before the cover film 17a is torn, the tearing end of the cover film 17a is peeled and raised by the pulling force of the tear tape 17b, so that it is removed from the limiting member 18, so that the force required for removing the tear tape 17b becomes extremely large. In this embodiment, the tearing end of the cover film 17a is confined by the end seal 21, so that the peeling and raising of the tearing end is prevented upon the pulling of the tear tape, and therefore, the cover film 17a is assuredly torn.

If the urging force of the tearing end of the cover film by the end sealing member 21 is too small, the peel preventing effect is not expected. If it is too large, the opening strength of the tear tape 17a becomes large. In consideration, the pressing force is preferably 1.0 kgf–3.0 kgf, further preferably 1.2 kgf–2.0 kgf.

When foamed polyurethane, foamed polyethylene, foamed polypropyrene or the like is used as the material for the end seal 21, and when a distance between the developing device frame 12b and the limiting member 18 mounted to the toner container 12a is 1–2 mm, the end seal 21 of 2–5 mm thick is compressed to ½–⅓ approx. thickness.

In this embodiment, the distance between the frame 12b and the limiting member 18 is 1 mm, and the end seal member 21 of foamed polyurethane having a thickness of 2 mm is mounted, and it is compressed to the thickness of approx. ½, by which the tearing end of the cover film 17a is pressed by the force of approx. 1.5 kgf.

(Seal preventing structure)

In this manner, the pulling direction of the tear tape 17b is regulated. However, when the tear tape 17b is pulled out, there is a liability that the end seal member 21 is partly peeled by the tear tape 17b. When the end seal 21 is peeled, the pulling force is significantly increased to 7–8 kg, although usually it is 5 kg. In this embodiment, as shown in FIG. 34, a projection 23 is provided at a portion of the end seal 21 adjacent the pulling side of the tear tape 17b, by which the end seal 21 is prevented from being peeled.

Figures 35, 36:
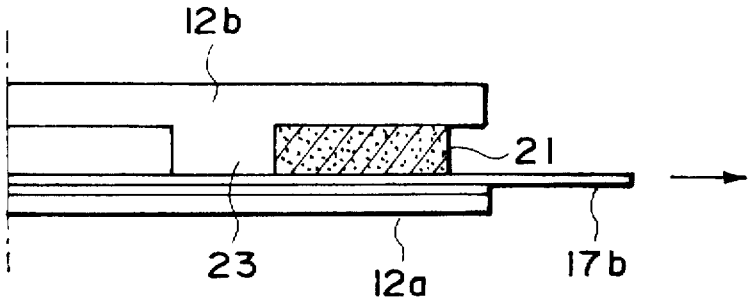
FIG. 35 is a sectional view having an end seal.
FIG. 36 is a table of experimental results as to amount of curling, tearing expansion width and tearing stability in a heat seal pattern of the cover film and the tear tape.

As shown in FIGS. 34 and 35, the projection 23 is contacted to an upstream end, with respect to the tear tape pulling direction, of the end seal 21. In this embodiment, the projection 23, as shown in FIG. 35, has a height H of approx. 0.3–0.5 mm, a width W of approx. 3–5 mm. It is integral with the developing frame 12b (separate polystyrene members of the similar shape may be mounted to the developing device frame 12b). To an end of the projection 23, the upstream end of the end seal member 21 is contacted, and the end seal 21 is bonded. The dimension of the projection 23 measured in the direction of width of the tear tape 17b (perpendicular to the sheet of the drawing of FIG. 35) is preferably larger than the width of the tear tape 17b, but it is not inevitably larger than the width of the tear tape 17b, or it may be intermittently provided.

It is desirable that the corner of the projection 23 is formed into R (rounded) to reduce the resistance against the pulling of the tear tape 17b.

Because of the provision of the projections 23, as shown in FIG. 35, when the tear tape 17b is pulled in a direction of the arrow, the projections 23 are contacted to the ends of the sealing member 21, so that the sealing member 21 is prevented from peeling and raising by the tear tape 17b. Therefore, the stabilized pulling operativity is accomplished without increase of the required pulling force of the tear tape 17b.

The projections 23 may be integrally formed with the developing frame 12b, or may be separate members.

In the foregoing embodiments, an opening limiting member 18 is mounted to limit the open area of the toner container 12a, and the sealing member 17 is mounted to the opening limiting member 18, but the provision of the opening limiting member 18 is not inevitable, but the sealing member 17 may be mounted directly to the opening of the toner container.

In the embodiment described above, the cover film 17a and the flexible tear tape 17b are integrally formed, and the cover film 17a is torn by the tear tape 17b, but the sealing member may be in the form of a so-called easy peel film.

The description will be made as to the easy peel film used as a sealing member 17. The preferable example of the easy film comprises a first base, a second base, a cushion layer and a sealant layer. However, this is not limiting the present invention.

As for the first base member, drawn polypropyrene film or the like has been used conventionally. However, with the possibility of film tear problem or the like, biaxial oriented polyethylene film exhibiting higher film strength is used.

As for the second base, a nylon layer to provide the strength (toughness) with the film, but the nylon exhibits a very high moisture absorbing property with the result of easy curling, and therefore, biaxial oriented polyester film similarly to the first base is preferably used.

The second base may have an arrow or the like printed thereon for instructing properly the operator with the opening direction of the toner container or the like.

When the print is not given, the first base and the second base may be used as one layer base. The one layer base exhibits better seal bonding property, and the print is clear.

In this case, a biaxial oriented polyester film having a film thickness corresponding to those of the first and second bases, is used.

After the printing is effected on the second base, the first base member and the second base member are laminated into one base material.

The bonding strength between the first and second bases by the lamination is higher than the bonding strength between the sealant layer and the toner container since otherwise the first and second bases are peeled from each other upon the opening. Therefore, a strong bonding method is used, such as with the use of polyester bonding material using a binder material similar to the film base.

The lamination is carried out so that no crease occurs in the first and second bases and that no air or the like is introduced therebetween.

As for the cushion layer, a polyethylene layer is used. In order to increase the cushion effect upon the heat sealing, low molecular weight (approx. 10,000) is preferably used.

As the sealant layer, ethylene-vinyl acetate copolymer sealant is used for example, preferably it is a material containing approx. 1–20% by weight vinyl acetate copolymer.

The sealant layer contains adhesiveness having material or slipping material or the like to provide adjusted and well-balanced easy peel property. As for the easy peeling function, as speculated in JIS, when it is peeled at 15 mm width and 30 mm, the force is approx. 1 kg/15 mm–3 kg/15 mm, approximately. This is the value when the seal film heat-sealed with the lowest sealing pressure onto a flat plate mainly comprising polystyrene or the like, is peeled in the direction of 180 degrees.

Actually, the seal bonding strength and the opening strength changes with how much the cushion layer and the sealant layer are collapsed or how the seal surface of the toner container deforms (depressed) by the heat and pressure of the heat seal operation, depending on the sealing condition relative to the toner container.

The film thickness of each layer of the easy peel film having the four layer structure is as follows from the standpoint of the balance between the seal bonding strength and the opening force. The first base has a thickness of 10–30 μm; the second base, 10–30 μm; the cushion layer, 10–30 μm; and the sealant layer, 30–50 μm. Further preferably, the first base has a thickness of 10–20 μm; the second base, 20–30 μm; the cushion layer, 20–30 μm; and the sealant layer, 40–50 μm. As for the manufacturing method for the easy peel film, the first base and second base are laminated, and the base layers and the sealant layer are bonded by fused cushion layer, and thereafter, they are cooled and wound up.

The opening may be sealed by such an easy peel film.

(Results of experiments)

The description will be made as to the experiments with the sealing member 17. In the first experiment, various cover films 17*a* and tear tapes 17*b* are produced, and the curling amount and tearing stability are investigated of the sealing member 17 with various seal patterns. In the second experiment, the sealing member 17 is fused on the opening limiting member with various seal patterns, and opening strength and the durability against pressure are shown.

(Experiment 1-1)

The cover film 17*a* is produced by dry-laminating a sealant layer 17*a*2 of ethylenevinylacetate (EVA) material of 20 μm-thick on a base 17*a*1 of uniaxial foamed polypropylene having a thickness of 140 μm. The tear tape 17*b* comprises a base 17*b*1 of biaxial polyester film of 38 μm-thick, an EVA sealant layer 17*b*2, a drawn nylon layer N as a cushion layer of 15 μm-thick, with the layer structure shown in FIG. 9. The sealing member 17 is manufactured by heat-sealing them.

The size of the cover film 17*a* is 53.5 mm×237 mm; the size of the tear tape 17*b* is 38.5 mm×575 mm; and the heat sealing condition is 120° C., 5.0 kg/cm$^2$, 3 sec. The seal pattern for integrating the cover film 17*a* and the tear tape 17*b* is as shown in FIG. 27, and the seal width W1 is 5 mm.

FIG. 36 shows results of measurements of the curling amount of the sealing member 17 in the width direction shown in FIG. 26. As will be understood, when the width of the tear tape 17*b* is very large such as approx. 40 mm, the curling amount can be suppressed to a very low level, that is 2 mm.

Such a sealing member 17 is heat-sealed on the sealing surface of the opening limiting member 18 having a thickness of 0.5 mm, an opening of 36.5 mm×220 mm and made of polystyrene plate after corona discharge treatment. At this time, the curling amount of the sealing member 17 is so small that there arises no problem, and therefore, no seal deviation occurs on the seal surface of the opening limiting member 18, and in addition, the automization of the production is considered possible.

The heat seal condition is 140° C., 3.0 kg/cm$^2$ and 5.5 sec. The sealing surfaces between the seal bar 19*a* and the opening limiting member 18 are confirmed to be correctly parallel, and thereafter, the heat seal is effected.

Thereafter, on the flange surface of the toner container 12, the opening limiting member 18 on which the sealing member 17 is mounted is fixed through ultrasonic wave fusing process, by which the toner container 12 is manufactured. Using the toner accommodating container 12*a*, the process cartridge B is manufactured.

As for the end seal member 21 of foamed polyurethane material, it has a dimension of 2 mm in order that the toner leakage from the tape removing portion of the opened cartridge B upon the removal of the cartridge from the main assembly upon trouble such as sheet jam or the like, and in order that the balance is provided relative to the opening strength.

The process cartridge B is opened at approx. 3000 mm/min, and a tearing expansion width of the cover film 17*a* after the opening and the occurrence of fuzziness (tearing stability) from the end surface of the cover film 17*a* upon the opening.

The results are shown in FIG. 36. As will be clear from these results, the tearing expansion width is not more than 1 mm, and therefore, the opening width of the developing means is sufficiently limited, and the tearing stability is good.

(Experiment 1-2)

Similarly to the Experiment 1-1, the seal pattern for unifying the cover film 17*a* and the tear tape 17*b* is dots as shown in FIG. 28, and the seal width W1 is 5 mm.

The curling amount K1 of the sealing member 17 is very small as shown in FIG. 36. In addition, the seal deviation relative to the limiting member 18 does not occur. The automization of the sealing process is considered possible. In addition, similarly to Experiment 1-1, a process cartridge B is manufactured, and the check is made as to the tearing expansion width and the tearing stability of the cover film 17*a*. As shown in FIG. 36, the results are very satisfactory.

(Experiment 1-3)

Similarly to Experiment 1-1, the seal pattern for unifying the cover film 17*a* and the tear tape 17*b* is as shown in the form of a channel, as shown in FIG. 29. The sealing width W1 is 7 mm.

The curling amount K1 of the sealing member 17 is very low as shown in FIG. 36, and there is no seal deviation to the limiting member 18, and the automization of the sealing process is considered possible. Similarly to Experiment 1-1, a process cartridge B is manufactured, and the tearing expansion width and the tearing stability of the cover film 17*a* after the opening are checked. As shown in FIG. 36, the results are very satisfactory.

(Experiment 1-4)

This experiment is the same as Experiment 1-1with the exception that the sealant layer 17*b*2 is applied only to one side of the tear tape 17*b* as shown in FIG. 8B.

The curling amount K1 of the sealing member 17 is very small as shown in FIG. 36, and the seal deviation relative to the limiting member 18 does not occur. Automization of the sealing process is considered possible.

Similarly to Experiment 1-1, a process cartridge B is manufactured, and the tearing expansion width and the tearing stability of the cover film 17*a* after the opening are checked. The results are shown in FIG. 36, and are very satisfactory.

(Experiment 1-a)

The cover film 17*a* and the tear tape 17*b* are made of the same material and under the same sealing conditions as in the Experiment 1-1. However, the seal pattern is as shown in FIG. 25, that is, the entire surface S2 where the cover film 17*a* and the tear tape 17*b* are overlapped except for the seal portion of the sealing member 17 corresponding to the opening, that is, the entire surface of the seal pattern S3 in FIG. 27 including the non-seal portion.

The curling amount of the sealing member 17 is 15.5 mm as shown in FIG. 36 which is very large with the result that the positioning of the sealing to the opening limiting member 18 is not easy with the result of frequent occurrences of seal deviation, and the automization of the sealing process is not considered possible.

(Experiment 1-b)

Cover film 17*a* and the tear tape 17*b* are made of the same materials as in Experiment 1-1, and are unified under the same sealing conditions, but with the sealing pattern of FIG. 30, that is, the non-seal portion in the seal pattern S3 of FIG. 27 is also sealed (S4).

The curling amount of the sealing member 17, as shown in FIG. 36, is as large as 10.3 mm, and therefore, the seal positioning to the opening limiting member 18 is not good with the result of frequent occurrence of the sealing deviation, and therefore, the automization of the sealing process is not considered possible.

Similarly to Experiment 1-1, a process cartridge B is manufactured, and the tearing expansion width and the tearing stability of the cover film 17*a* after the opening are checked. The results are shown in FIG. 36, and the tearing expansion width is 4.5 mm, and therefore, the tearing is not stabilized, and in addition, the cover film 17*a* becomes fuzzy.

The causes are considered as follows. Since the unification of the portion of the start of the tearing is not assured with the result that by the friction with the end seal 21 with the pulling portion, the cover film 17*a* is peeled from the tear tape 17*b* with the result of fuzzy or non-smooth surface, with the expansion of the tearing width.

(Experiment 2-1)

The use is made with the sealing member 17 and the opening limiting member 18 as in Experiment 1-1, and the sealing condition of the sealing member to the opening limiting member 18 is 140° C., 5.0 kg/cm$^2$, and 5.5 sec. After the confirmation of the correct parallelism between the seal bar 19*a* and the sealing surface of the opening limiting member 18, and thereafter, the heat seal is carried out. Thereafter, the opening limiting member 18 sealed by the sealing member 17 is ultrasonic wave-fused on the flange surface of the toner container 12*a*, thus manufacturing the toner container.

Two sealing patterns for the sealing of the sealing member 17 onto the opening limiting member 18, are used as shown in FIG. 31. Samples 1 and 2 are manufactured with the pattern dimensions shown in FIG. 37.

As a Comparison Example, seal patterns shown in FIGS. 32 and 33, are used with the pattern dimensions shown in FIG. 37 as samples a and b.

The four kinds of toner containers 12*a* are coupled by ultrasonic wave fusing with the developing device frame 12*b* provided with a boss for opening direction support, so that four kinds of process cartridges are produced.

The distance between the opening limiting member 18 and the frame 12*b* is 1 mm, and the end seal member 21 of foamed polyurethane has a thickness of 2 mm.

The process cartridge B is opened at a speed of approx. 3000 mm/min. The opening strength (required force to open) is shown in FIG. 37. As will be apparent, there occurs no toner scattering upon the opening of the seal member 17 in four examples. However, the opening strength is very low in samples 1 and 2, and the operativity in the opening is very good.

On the other hand, samples a and b (Comparison Examples) exhibited very large opening strength, and therefore, the operativity is low even to the extent of incapability of opening by an operator.

Using the four kinds of toner containers 12*a* and the process cartridge, the puncture strength and the failing test (after 550 g of the toner is loaded) are carried out.

As for the puncture strength, the durability against the pressure is measured until the sealing member 17 is removed and the puncture occurs by the internal pressure when the pressure is increased by 0.05 kgf/cm$^2$ and the pressure is maintained for 5 sec, and this is repeated. In the falling test, three cartridges are altogether let fall from the height of 90 cm. The cartridge is let fall 10 times for one group in one-corner 3-edge 6-surface mode and 6-surface 4-corner mode, and the toner leakage is confirmed.

The results are shown in FIG. 38. As will be apparent from the results, even if the short side seal pattern width T is reduced by 1 mm–1.5 mm as compared with the longitudinal seal pattern width T1, the sufficient durability is maintained against puncture and falling.

From the above tests, it has been confirmed that using the seal pattern of the embodiments, the toner container exhibits low opening strength, high opening operativity and high durability against pressure.

(Experiment 2-2)

As for the sealing member for sealing the opening 18*a* of the opening limiting member 18, an easy peel film is used. The easy peel film comprises a first base of biaxial oriented polyester film having a thickness of 16 μm, a second base of biaxial polyester film having a thickness of 25 μm, a cushion layer of low molecular wave polyethylene film having a thickness of 20 μm, and an EVA sealant layer having a thickness of 30 μm (four-layer structure). The film size of the easy peel film is 46 mm×574 mm.

The sealing member is heat-sealed to the opening 18*a* of the opening limiting member 18 as in Experiment 2-1. The sealing conditions are 150° C., 5.0 kg/cm$^2$, 2.5 sec. After the confirmation of the correct parallelism between the seal bar 19*a* and the sealing surface of the opening limiting member 18, the heat seal operation is carried out. Thereafter, the opening limiting member 18 sealed by such a sealing member is fused to the flange surface of the toner container 12*a* by ultrasonic wave fusing, thus manufacturing the toner container.

Two kinds of seal patterns for mounting the sealing member to the opening limiting member 18 are produced as shown in FIG. 31, and the pattern dimensions are as shown in FIG. 39. The samples are called samples 3 and 4.

As Comparison Examples, seal patterns shown in FIGS. 32 and 33 are used with the pattern dimensions shown in FIG. 39. The samples are called samples c and d.

The four kinds of toner containers 12*a* are coupled by ultrasonic wave fusing with developing device frames 12*b* having a boss for opening direction support, thus producing four kinds of process cartridges.

The distance between the opening limiting member 18 and the developing frame 12*b* is 1 mm, and the end seal member 21 of foamed polyurethane has a thickness of 2 mm.

FIG. 39 shows the opening strength when the process cartridge B is opened approx. at 3000 mm/min. As will be apparent from these results, the toner scattering does not occur upon the opening of the sealing member 17 for the four kinds of the cartridges. However, with samples 3 and 4, the opening strength is very low, and therefore, the operativity upon the opening is very satisfactory.

On the other hand, with respect to the samples c and d (Comparison Examples), the opening strength is very high, and the opening operativity is poor even to such an extent of incapability of opening by an operator.

Using the four kinds of toner containers 12*a* and the process cartridge B, the puncture and falling tests are carried out under the same conditions as in Experiment 2-1. The results are shown in FIG. 40. As will be understood from the results, even if the short side seal pattern width T2 is reduced by 1–1.5 mm as compared with the longitudinal seal pattern width T1, the sufficient durability strength is maintained in the puncture test and the falling test.

As will be understood from the foregoing, even when the easy peel film is used as the sealing member, the toner container exhibits low opening strength, the good opening operativity and high durability against pressure by the use of the seal pattern described above.

(Experiment 2-3)

Using the cover film 17*a* similar to the cover film 17*a* used in Experiment 2-1, a tear tape 17*b* of four layer easy peel film is heat-sealed, and three kinds of tear seal member 17 having different sizes are produced as samples 5, 6 and sample e.

The tear tape 17*b* comprises biaxial oriented polyester layer having a thickness of 16 μm, a biaxial oriented nylon layer having a thickness of 25 μm, a low molecular weight polyethylene layer having a thickness of 30 μm, and an EVA sealant layer having a thickness of 40 μm. The heat seal condition of the tear tape 17*b* is 120° C., 5 kg/cm$^2$ and 3 sec.

The size of the cover film 17*a* of sample 5 is 44.0×310 mm; size of tear tape 17*b* is 32.0×700 mm; the size of the cover film 17*a* of sample 6 is 44.0×320 mm; the size of the tear tape 17*b* is 32.0×700 mm; the size of the cover film 17*a* of sample e is 44.0×348 mm, and the size of the tear tape 17*b* is 32.0×700 mm.

The sealing member 17 is heat-sealed on the sealing surface of the toner container 12*a* having an opening of 30.0 mm×301 mm with the seal pattern of FIG. 31 and with the pattern dimension shown in FIG. 41 after corona discharge treatment. After confirmation of the correct parallelism between the seal bar 19*a* and the flange surface of the toner container 12*a* is confirmed, the heat sealing is effected. Three kinds of toner containers 12*a* are coupled with developing device frames 12*b* having opening direction supporting bosses by ultrasonic wave bonding, thus producing three process cartridges.

The clearance between the toner container 12*a* and the frame 12*b* is 1 mm, and the end seal 21 of foamed polyurethane has a thickness of 2 mm.

FIG. 41 shows the results of opening strength when the process cartridge B is opened at a speed of approx. 3000 mm/min. As will be understood from the results, the opening strength of the sealing member of each of the three kinds is very low, and therefore, the operativity is very good. Particularly, in the case of the mountain type sealing pattern having an apex angle θ not more than 90 degrees in sample e is the lowest.

However, with samples 5 and 6, the toner scattering does not occur upon the opening of the sealing member, but with sample e the toner exists between the sealing member 17 and the flange of the toner container 12*a* because of the large width Y6 (24 mm) at the end of the flange, and therefore, the toner scatters upon the opening of the sealing member with the result of contamination in the neighborhood.

Using the three kinds of toner containers 12*a* and the process cartridges B, the puncture strength and the falling tests are carried out under the same condition as in Experiments 2-1. The results are shown in FIG. 42. As will be understood from this, the sufficient durability against pressure is provided against puncture and falling with samples 5 and 6.

With sample e, however, the seal is loose adjacent the apex of the seal pattern because of the large width Y6 (24 mm) at the ends of the flange, and therefore, the seal is peeled from the apex of the mountain seal pattern in both of the puncture strength and falling tests. The toner leakage occurs at the same position.

From the foregoing, the angle θ and the width Y6 are preferably within certain ranges.

(Experiment 2-4)

As for the sealing member 17, an easy peel film is used to hermetically seal the opening 12*a*1 of the toner container 12*a*. The easy peel film comprises a first base of biaxial oriented polyester film having a thickness of 16 mm, and a second base of biaxial polyester film having a thickness of 25 μm, a cushion layer of low molecular weight polyethylene having a thickness of 20 μm, an EVA sealant layer having a thickness of 50 μm (four layer structure). The size of the easy peel film is 39.0×700 mm.

Such an easy peel film is heat-sealed on the sealing surface of the toner container 12a having an opening 12a1 of 30.0 mm×301 mm with the seal pattern shown in FIG. 31, the heat seal conditions are 180° C., 5.0 kg/cm$^2$ and 2.5 sec.

The heat seal pattern dimensions are as shown in FIG. 35, and samples 7, 8 and f are manufactured as three kinds of toner containers 12a. After confirmation of the correct parallelism between the seal bar 19a and the sealing surface of the flange of the toner container, the heat seal is carried out. Three toner containers 12a are coupled with developing device frames 12b having opening direction support bosses by ultrasonic wave fusing, thus producing three kinds of process cartridges.

The clearance between the toner container 12a and the frame 12b is 1 mm, and the foamed polyurethane end seal member 21 has a thickness of 2 mm.

The opening strength when the process cartridge B is opened at a speed at approx. 3000 mm/min. is shown in FIG. 43. As will be understood from these results, the opening strength of the sealing member is very low for all of the three kinds, and therefore, the operativity is very satisfactory. Particularly the opening strength is the lowest with sample f having a mountain like seal pattern with an apex angle of not more than 90 degrees.

Although the toner scattering is not observed upon the removal of the sealing member with respect to samples 7 and 8, but with respect to sample f, the toner exists between the sealing member and the flange of the toner container 12a in the mountain-like seal portion, and the toner scatters when the sealing member is removed, and the neighborhood is contaminated.

For the three kinds of toner containers 12a and the process cartridges B, the puncture strength and the falling tests are carried out under the same conditions as in Experiment 2-1. The results are shown in FIG. 44. As will be understood, it has been confirmed that the samples 7 and 8 maintain sufficient durability against pressure in the puncture and falling tests.

However, in the case of the sample f, the seal is loose adjacent the apex of the mountain shape because of the large end width Y6 (24 mm) of the flange, and the seal is peeled adjacent the apex in the puncture and falling tests, and the toner leakage occurs in the same position. From the foregoing, when the easy peel film is used as a sealing member, the angle θ of the mountain seal pattern and the end width Y6 of the flange are preferably within the predetermined range.

In the foregoing embodiments, the material of the toner container 12a is preferably anti-shock polyethylene material or the like added with butadiene rubber for the purpose of avoiding clack upon falling or impact during transportation. Furthermore, addition of bromine or phosphorus fire proof material is preferable.

(Other embodiments)

The process cartridge B of this embodiment is not limited to monochromatic image formation, but is applicable to a cartridge for multi-color image formation (two colors, three colors or full colors) using a plurality of developing means.

In the foregoing embodiment, the photosensitive layer of the image bearing member is of an organic photoconductor (OPC), but the present invention is not limited to this case. For example, it may be amorphous silicon (A—Si), selenium (Se), zinc oxide (ZnO) or cadmium sulfide (CdS) or the like. The shape of the image bearing member is not limited to a drum, but may be a belt.

As for the developing method, a known two-component magnetic brush developing method, a cascade developing method, a touch-down developing method, cloud developing method or another developing method is usable.

As for the charging means, in the foregoing embodiment, a so-called contact type charging method is used, but another known structure is usable. For example, metal shield of aluminum or the like is disposed to enclose three sides of a tungsten wire, which is supplied with a high voltage, thus producing positive or negative ions to the surface of the photosensitive drum so as to uniformly charge the surface of the drum.

The charging means may be a blade type (charging blade), pad type, block type, rod type or wire type.

As to the cleaning method for the toner remaining on the photosensitive drum, a blade, a fur brush, a magnetic brush or the like may be used.

The process cartridge described hereinbefore comprises an image bearing member in the form of an electrophotographic photosensitive member, for example, and at least one process means. Therefore, other process cartridges are as follows. An image bearing member and charging member are unified into a cartridge detachably mountable to the main assembly of the apparatus. An image bearing member and developing means are unified into a cartridge, which is detachably mountable to a main assembly of the apparatus. An image bearing member and cleaning means are unified into a cartridge, which is detachably mountable to a main assembly of the apparatus. An image bearing member and two or more process means are unified into a cartridge, which is detachably mountable to a main assembly of the apparatus. An image bearing member, charging means, developing means and/or cleaning means may be unified into a cartridge, which is detachably mountable to a main assembly of the apparatus.

The mounting member 15 for the photosensitive drum may be used in the case that the photosensitive drum is directly supported in the main assembly of the apparatus, as well as in the process cartridge.

In the foregoing, the toner container sealed by the sealing member S is a process cartridge as an example. The present invention is applicable to a toner replenishing type in which the toner container directly supplies the toner into the toner container in the main assembly of the apparatus.

In the foregoing, the image forming apparatus has been in the form of a laser beam printer, but the present invention is not limited to this, and is applicable to an LED printer, an electrophotographic copying machine, a facsimile machine, a word processor or another image forming apparatus.

As described in the foregoing, according to the present invention, the operativity in removing the sealing member is improved while leakage of the developer is prevented, in a developing apparatus, a process cartridge and an image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing a latent image formed on an electrophotographic photosensitive member, said developing apparatus comprising:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening;

an end seal for preventing leakage of the developer through an area between said first frame and said second frame, said end seal being disposed between said first frame and said second frame and downstream of the opening with respect to the pulling direction of said sealing member; and projections, surrounded by said end seal and disposed adjacent said sealing member at both sides of the pulling path downstream of the opening in the pulling direction, for limiting the pulling direction of said sealing member.

2. An apparatus according to claim 1, wherein said sealing member comprises a sealing film and a flexible tape having a first portion extended along a surface of said sealing film and a second portion at another surface of said sealing film, and wherein said sealing film is torn along said first portion of said flexible tape by pulling said second portion of said flexible tape.

3. A developing apparatus for developing a latent image formed on an electrophotographic photosensitive member, said developing apparatus comprising:

a first frame having a developer container for containing developer:

a second frame having a developer carrying member for carrying developer supplied from said developer container to supply the developer to the latent image:

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said projections are provided in said second frame and project from said second frame to said first frame, and wherein said projections are provided in said second frame, and said first frame is provided with openings for receiving said projections.

4. An apparatus according to claim 3, wherein said projections are in the form of bosses.

5. An apparatus according to claim 4, wherein said projections are inserted in holes formed in an end seal disposed downstream of the opening with respect to the pulling direction of said sealing member.

6. An apparatus according to claim 5, wherein an upstream boss is provided in contact with the end seal upstream of the end seal in the pulling direction, said upstream boss being effective to prevent peeling of the end seal when said sealing member is pulled.

7. An apparatus according to claim 5, wherein said first frame and said second frame push through the end seal a portion of said sealing member where said sealing member starts to peel off when said sealing member is pulled.

8. An apparatus according to claim 5, wherein a separate hard plate is disposed between said first frame and said second frame, and wherein said sealing member is mounted on the hard plate.

9. An apparatus according to claim 5, wherein said projections are 1 mm–3 mm away from the pulling path.

10. A developing apparatus for developing a latent image formed on an electrophotographic photosensitive member, said developing apparatus comprising:

a first frame having a developer container for containing developer;

a second frame having a developer carrying member for carrying developer supplied from said developer container to supply the developer to the latent image:

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said projections are inserted in holes formed in an end seal disposed downstream of the opening with respect to the pulling direction of said sealing member.

11. An apparatus according to claim 10, wherein a boss is provided in contact with the end seal upstream of the end seal in the pulling direction, said boss being effective to prevent peeling of the end seal when said sealing member is pulled.

12. An apparatus according to claim 10, wherein said first frame and said second frame push through the end seal a portion of said sealing member where said sealing member starts to peel off when said sealing member is pulled.

13. An apparatus according to claim 10, wherein a separate hard plate is disposed between said first frame and said second frame, and wherein said sealing member is mounted on the hard plate.

14. An apparatus according to claim 10, wherein said projections are 1 mm–3 mm away from the pulling path.

15. A developing apparatus for developing a latent image formed on an electrophotographic photosensitive member, said developing apparatus comprising:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said first frame and said second frame are joined by ultrasonic wave fusing.

16. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening;

an end seal for preventing leakage of the developer through an area between said first frame and said second frame, said end seal being disposed between said first frame and said second frame and downstream of the opening with respect to the pulling direction of said sealing member; and projections, surrounded by said end seal and disposed adjacent said sealing member at both sides of the pulling path downstream of the opening in the pulling direction, for limiting the pulling direction of said sealing member.

17. A process cartridge according to claim 16, wherein said sealing member comprises a sealing film and a flexible tape having a first portion extended along a surface of said sealing film and a second portion at another surface of said sealing film, and wherein said sealing film is torn along said first portion of said flexible tape by pulling said second portion of said flexible tape.

18. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said projections are provided in said second frame and project from said second frame to said first frame, and wherein said projections are provided in said second frame, and said first frame is provided with openings for receiving said projections.

19. A process cartridge according to claim 18, wherein said projections are in the form of bosses.

20. A process cartridge according to claim 19, wherein said projections are inserted in holes formed in an end seal disposed downstream of the opening with respect to the pulling direction of said sealing member.

21. A process cartridge according to claim 20, wherein an upstream boss is provided in contact with the end seal upstream of the end seal in the pulling direction, said upstream boss being effective to prevent peeling of the end seal when said sealing member is pulled.

22. A process cartridge according to claim 20, wherein said first frame and said second frame push through the end seal a portion of said sealing member where said sealing member starts to peel off when said sealing member is pulled.

23. A process cartridge according to claim 20, wherein a separate hard plate is disposed between said first frame and said second frame, and wherein said sealing member is mounted on the hard plate.

24. A process cartridge according to claim 20, wherein said projections are 1 mm–3 mm away from the pulling path.

25. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said projections are inserted in holes formed in an end seal disposed downstream of the opening with respect to the pulling direction of said sealing member.

26. A process cartridge according to claim 25, wherein a boss is provided in contact with the end seal upstream of the end seal in the pulling direction, said boss being effective to prevent peeling of the end seal when said sealing member is pulled.

27. A process cartridge according to claim 25, wherein said first frame and said second frame push through the end seal a portion of said sealing member where said sealing member starts to peel off when said sealing member is pulled.

28. A process cartridge according to claim 25, wherein a separate hard plate is disposed between said first frame and said second frame, and wherein said sealing member is mounted on the hard plate.

29. A process cartridge according to claim 25, wherein said projections are 1 mm–3 mm away from the pulling path.

30. A process cartridge detachably mountable to a main assembly of an image forming apparatus, said process cartridge comprising:

an electrophotographic photosensitive member: and a developing device for developing a latent image formed on said electrophotographic photosensitive member, said developing device including:

a first frame having a developer container for containing developer;

a second frame having a developer carrying member for carrying developer supplied from said developer container to supply the developer to the latent image:

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said first frame and said second frame are joined by ultrasonic wave fusing.

31. An image forming apparatus usable with a process cartridge detachably mountable thereto, said image forming apparatus comprising:

(a) a mount for detachably mounting a process cartridge, wherein the process cartridge includes:

an electrophotographic photosensitive member; and a developing device for developing a latent image formed on the electrophotographic photosensitive member, the developing device including:

a first frame having a developer container for containing developer;

a second frame having a developer carrying member for carrying developer supplied from the developer container to supply the developer to the latent image;

a sealing member for sealing an opening for supplying the developer from the developer container to the developer carrying member, the sealing member being pullable between the first frame and the second frame along a pulling path in a pulling direction to open the opening;

an end seal for preventing leakage of the developer through an area between the first frame and the second frame, the end seal being disposed between the first frame and the second frame and downstream of the opening with respect to the pulling direction of the sealing member; and projections, surrounded by the end seal and disposed adjacent the sealing member at both sides of the pulling path downstream of the opening in the pulling direction, for limiting the pulling direction of the sealing member;

(b) transfer means for transferring a toner image onto a recording material from the electrophotographic photosensitive member of the process cartridge mounted to said mount; and (c) feeding means for feeding the recording material.

32. A developing apparatus for developing a latent image formed on an image bearing member, said developing apparatus comprising:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening;

an end seal for preventing leakage of the developer through an area between said first frame and said second frame, said end seal being disposed between said first frame and said second frame and downstream of the opening with respect to the pulling direction of said flexible tape; and projections, surrounded by said end seal and disposed adjacent said flexible tape at both sides of the pulling path downstream of the opening in the pulling direction, for limiting the pulling direction of said flexible tape.

33. A developing apparatus for developing a latent image formed on an image bearing member, said developing apparatus comprising:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening; and projections, disposed adjacent said flexible tape at both sides of the pulling path downstream of the opening in the pulling direction, for limiting the pulling direction of said flexible tape, wherein said projections are provided in said second frame and project from said second frame to said first frame, and wherein said projections are provided in said second frame, and said first frame is provided with openings for receiving said projections.

34. An apparatus according to claim 33, wherein said projections are in the form of bosses.

35. An apparatus according to claim 34, wherein said projections are inserted in holes formed in an end seal disposed downstream of the opening with respect to the pulling direction of said flexible tape.

36. An apparatus according to claim 35, wherein an upstream boss is provided in contact with the end seal upstream of the end seal in the pulling direction, said upstream boss being effective to prevent peeling of the end seal when said flexible tape is pulled.

37. An apparatus according to claim 35, wherein said first frame and said second frame push through the end seal a portion of said seal film where said seal film starts to peel off when said flexible tape is pulled.

38. An apparatus according to claim 35, wherein a separate hard plate is disposed between said first frame and said second frame, and wherein said seal film is mounted on the hard plate.

39. An apparatus according to claim 35, wherein said projections are 1 mm–3 mm away from the pulling path.

40. A developing apparatus for developing a latent image formed on an image bearing member, said developing apparatus comprising:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening; and projections, disposed adjacent said flexible tape at both sides of the pulling path downstream of the opening in the pulling direction, for limiting the pulling direction of said flexible tape, wherein said projections are inserted in holes formed in an end seal disposed downstream of the opening with respect to the pulling direction of said flexible tape.

41. An apparatus according to claim 40, wherein a boss is provided in contact with the end seal upstream of the end seal in the pulling direction, said boss being effective to prevent peeling of the end seal when said flexible tape is pulled.

42. An apparatus according to claim 40, wherein said first frame and said second frame push through the end seal a portion of said seal film where said seal film starts to peel off when said flexible tape is pulled.

43. An apparatus according to claim 40, wherein a separate hard plate is disposed between said first frame and said second frame, and wherein said seal film is mounted on the hard plate.

44. An apparatus according to claim 40, wherein said projections are 1 mm–3 mm away from the pulling path.

45. A developing apparatus for developing a latent image formed on an image bearing member, said developing apparatus comprising:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening; and projections, disposed adjacent said flexible tape at both sides of the pulling path downstream of the opening in the pulling direction, for limiting the pulling direction of said flexible tape, wherein said first frame and said second frame are joined by ultrasonic wave fusing.

46. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening;

an end seal for preventing leakage of the developer through an area between said first frame and said second frame, said end seal being disposed between said first frame and said second frame and downstream of the opening with respect to the pulling direction of said flexible tape; and projections, surrounded by said end seal and disposed adjacent said flexible tape at both sides of the pulling path downstream of the opening in the pulling direction, for limiting the pulling direction of said flexible tape.

47. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening; and projections, disposed adjacent said flexible tape at both sides of the pulling path downstream of the opening in the pulling direction, for limiting the pulling direction of said flexible tape, wherein said projections are provided in said second frame and project from said second frame to said first frame, and wherein said projections are provided in said second frame, and said first frame is provided with openings for receiving said projections.

48. A process cartridge according to claim 47, wherein said projections are in the form of bosses.

49. A process cartridge according to claim 48, wherein said projections are inserted in holes formed in an end seal disposed downstream of the opening with respect to the pulling direction of said flexible tape.

50. A process cartridge according to claim 49, wherein an upstream boss is provided in contact with the end seal upstream of the end seal in the pulling direction, said upstream boss being effective to prevent peeling of the end seal when said flexible tape is pulled.

51. A process cartridge according to claim 49, wherein said first frame and said second frame push through the end seal a portion of said seal film where said seal film starts to peel off when said flexible tape is pulled.

52. A process cartridge according to claim 49, wherein a separate hard plate is disposed between said first frame and said second frame, and wherein said seal film is mounted on the hard plate.

53. A process cartridge according to claim 49, wherein said projections are 1 mm–3 mm away from the pulling path.

54. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening;

projections, disposed adjacent said flexible tape at both sides of the pulling path downstream of the opening in the pulling direction, for limiting the pulling direction of said flexible tape, wherein said projections are inserted in holes formed in an end seal disposed downstream of the opening with respect to the pulling direction of said flexible tape.

55. A process cartridge according to claim 54, wherein a boss is provided in contact with the end seal upstream of the end seal in the pulling direction, said boss being effective to prevent peeling of the end seal when said flexible tape is pulled.

56. A process cartridge according to claim 54, wherein said first frame and said second frame push through the end seal a portion of said seal film where said seal film starts to peel off when said flexible tape is pulled.

57. A process cartridge according to claim 54, wherein a separate hard plate is disposed between said first frame and said second frame, and wherein said seal film is mounted on the hard plate.

58. A process cartridge according to claim 54, wherein said projections are 1 mm–3 mm away from the pulling path.

59. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening; and projections, disposed adjacent said flexible tape at both sides of the pulling path downstream of the opening in the pulling direction, for limiting the pulling direction of said flexible tape, wherein said first frame and said second frame are joined by ultrasonic wave fusing.

60. An image forming apparatus usable with a process cartridge detachably mountable thereto, said image forming apparatus comprising:

(a) a mount for detachably mounting a process cartridge, wherein the process cartridge includes:

an electrophotographic photosensitive member; and a developing device for developing a latent image formed on the electrophotographic photosensitive member, the developing device including:

a first frame having a developer container for containing developer;

a second frame having a developer carrying member for carrying developer supplied from the developer container to supply the developer to the latent image;

a seal film for sealing an opening for supplying the developer from the developer container to the developer carrying member;

a flexible tape having a first portion extended along a surface of the seal film and a second portion, reversely extended from an end of the first portion, at another surface of the seal film, the second portion of the flexible tape being pullable between the first frame and the second frame along a pulling path in a pulling direction such that the seal film is torn along the first portion to open the opening;

an end seal for preventing leakage of the developer through an area between the first frame and the second frame, the end seal being disposed between the first frame and the second frame and downstream of the opening with respect to the pulling direction of the flexible tape; and projections, surrounded by the end seal and disposed adjacent the flexible tape at both sides of the pulling path downstream of the opening in the pulling direction, for limiting the pulling direction of the flexible tape;

(b) transfer means for transferring a toner image onto a recording material from the electrophotographic photosensitive member of the process cartridge mounted to said mount; and (c) feeding means for feeding the recording material.

61. A developing apparatus for developing a latent image formed on an electrophotographic photosensitive member, said developing apparatus comprising:

a first chamber for containing developer;

a second chamber having a developer carrying member for carrying developer supplied from said first chamber to supply the developer to the electrophotographic photosensitive member;

a hard member as a partition between said first chamber and said second chamber, said hard member being a separate member from said first chamber and said second chamber and being mounted on a member constituting said first chamber, said hard member having an opening to said first chamber for the developer;

a seal film for sealing the opening;

a flexible tape having a first portion extended along a surface of said seal film and a second portion at another surface of said seal film, said second portion being reversely extended from an end of said first portion, said second portion of said flexible tape being pullable between said first chamber and said second chamber along a pulling path in a pulling direction such that said flexible tape is torn along said first portion to open the opening; and projections, disposed adjacent said flexible tape at both sides of the pulling path downstream of the opening in the pulling direction, for limiting the pulling direction of said seal film.

62. An apparatus according to claim 61, wherein said projections are provided in a member constituting said second chamber and project from said member constituting said second chamber to said member constituting said first chamber.

63. An apparatus according to claim 62, wherein said projections are provided in said member constituting said second chamber, and said first chamber is provided with openings for receiving said projections.

64. An apparatus according to claim 61 or 63, wherein said projections are in the form of bosses.

65. An apparatus according to claim 64, wherein said projections are inserted in holes formed in an end seal disposed downstream of the opening with respect to the pulling direction of said flexible tape.

66. An apparatus according to claim 65, wherein an upstream boss is provided in contact with the end seal upstream of the end seal in the pulling direction, said upstream boss being effective to prevent peeling of the end seal when said flexible tape is pulled.

67. An apparatus according to claim 65, wherein said first chamber and said second chamber push through the end seal a portion of said seal film where said seal film starts to peel off when said flexible is pulled.

68. An apparatus according to claim 65, wherein said projections are 1 mm–3 mm away from the pulling path.

69. An apparatus according to claim 61, wherein said projections are inserted in holes formed in an end seal disposed downstream of the opening with respect to the pulling direction of said flexible tape.

70. An apparatus according to claim 69, wherein a boss is provided in contact with the end seal upstream of the end seal in the pulling direction, said boss being effective to prevent peeling of the end seal when said flexible tape is pulled.

71. An apparatus according to claim 69, wherein said first chamber and said second chamber push through the end seal a portion of said seal film where said seal film starts to peel off when said flexible tape is pulled.

72. An apparatus according to claim 61 or 69, wherein said projections are 1 mm–3 mm away from the pulling path.

73. An apparatus according to claim 61, wherein said first chamber and said second chamber are joined by ultrasonic wave fusing.

74. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first chamber for containing developer;

a second chamber having a developer carrying member for carrying developer supplied from said first chamber to supply the developer to said electrophotographic photosensitive member;

a hard member as a partition between said first chamber and said second chamber, said hard member being a separate member from said first chamber and said second chamber and being mounted on a member constituting said first chamber, said hard member having a developer supply opening which opens to said second chamber for the developer;

a flexible tape having a first portion extended along a surface of a seal film and a second portion at another surface of the seal film, said second portion being reversely extended from an end of said first portion, said second portion of said flexible tape being pullable between said first chamber and said second chamber along a pulling path in a pulling direction such that said seal film is torn along said first portion to open the opening; and projections, disposed adjacent said flexible tape at both sides of the pulling path downstream of the opening in the pulling direction, for limiting the pulling direction of said flexible tape.

75. A process cartridge according to claim 74, wherein said projections are provided in a member constituting said second chamber and project from said member constituting said second chamber to said member constituting said first chamber.

76. A process cartridge according to claim 75, wherein said projections are provided in a member constituting said second chamber, and said first chamber is provided with openings for receiving said projections.

77. A process cartridge according to claim 74 or 76, wherein said projections are in the form of bosses.

78. A process cartridge according to claim 77, wherein said projections are inserted in holes formed in an end seal disposed downstream of the opening with respect to the pulling direction of said flexible tape.

79. A process cartridge according to claim 78, wherein an upstream boss is provided in contact with the end seal upstream of the end seal in the pulling direction, said upstream boss being effective to prevent peeling of the end seal when said flexible tape is pulled.

80. A process cartridge according to claim 78, wherein said first chamber and said second chamber push through the end seal a portion of the seal film where the seal film starts to peel off when said flexible tape is pulled.

81. A process cartridge according to claim 77, wherein said projections are 1 mm–3 mm away from the pulling path.

82. A process cartridge according to claim 74, wherein said projections are inserted in holes formed in an end seal disposed downstream of the opening with respect to the pulling direction of said flexible tape.

83. A process cartridge according to claim 82, wherein a boss is provided in contact with the end seal upstream of the end seal in the pulling direction, said boss being effective to prevent peeling of the end seal when said flexible tape is pulled.

84. A process cartridge according to claim 82, wherein said first chamber and said second chamber push through the end seal a portion of the seal film where the seal film starts to peel off when said flexible tape is pulled.

85. A process cartridge according to claim 74, wherein said projections are 1 mm–3 mm away from the pulling path.

86. A process cartridge according to claim 74, wherein said first chamber and said second chamber are joined by ultrasonic wave fusing.

87. An image forming apparatus usable with a process cartridge detachably mountable thereto, said image forming apparatus comprising:

(a) a mount for detachably mounting a process cartridge, wherein the process cartridge includes:

an electrophotographic photosensitive member; and a developing device for developing a latent image formed on the electrophotographic photosensitive member, the developing device including;

a first chamber for containing developer;

a second chamber having a developer carrying member for carrying developer supplied from the first chamber to supply the developer to the electrophotographic photosensitive member;

a hard member as a partition between the first chamber and the second chamber, the hard member being a separate member from the first chamber and the second chamber and being mounted on a member constituting the first chamber, the hard member having an opening to the first chamber for the developer;

a flexible tape having a first portion extended along a surface of a seal film and a second portion at another surface of the seal film, the second portion being reversely extended from an end of the first portion, the second portion of the flexible tape being pullable between the first chamber and the second chamber along a pulling path in a pulling direction such that the flexible tape is torn along the first portion to open the opening; and projections, disposed at both sides of the pulling path downstream of the opening in the pulling direction, for limiting the pulling direction of the seal film;

(b) transfer means for transferring a toner image onto a recording material from the electrophotographic photosensitive member of the process cartridge mounted to said mount; and (c) feeding means for feeding the recording material.

88. A developing apparatus for developing a latent image formed on an electrophotographic photosensitive member, said developing apparatus comprising:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling oath in a pulling direction to open the opening;

an end seal disposed downstream of the opening with respect to the pulling direction; and a projection disposed in contact with said end seal upstream of said end seal with respect to the pulling direction.

89. An apparatus according to claim 88, wherein said projection is provided on said second frame and projects from said second frame to said first frame.

90. An apparatus according to claim 89, wherein said projection is formed integrally with said second frame.

91. An apparatus according to claim 88 or 90, wherein bosses are disposed adjacent said sealing member at both sides of the pulling path downstream of the opening in the pulling direction for limiting the pulling direction of said sealing member.

92. An apparatus according to claim 88 or 90, wherein said first frame and said second frame push through said end seal a portion of said sealing member where said sealing member starts to peel off when said sealing member is pulled.

93. A process cartridge detachably mountable to a main assembly of an image forming apparatus, said process cartridge comprising:

an electrophotographic photosensitive member; and a developing device for developing a latent image formed on said electrophotographic photosensitive member, said developing device including;

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening;

an end seal disposed downstream of the opening with respect to the pulling direction; and a projection disposed in contact with said end seal upstream of said end seal with respect to the pulling direction.

94. A process cartridge according to claim 93, wherein said projection is provided on said second frame and projects from said second frame to said first frame.

95. A process cartridge according to claim 94, wherein said projection is formed integrally with said second frame.

96. A process cartridge according to claim 93 or 95, wherein bosses are disposed adjacent said sealing member at both sides of the pulling path downstream of the opening in the pulling direction for limiting the pulling direction of said sealing member.

97. A process cartridge according to claim 93 or 95, wherein said first frame and said second frame push through said end seal a portion of said sealing member where said sealing member starts to peel off when said sealing member is pulled.

98. An image forming apparatus usable with a process cartridge detachably mountable thereto, said image forming apparatus comprising:

(a) a mount for detachably mounting a process cartridge, wherein the process cartridge includes:
an electrophotographic photosensitive member; and
a developing device for developing a latent image formed on the electrophotographic photosensitive member, the developing device including;
a first frame having a developer container for containing developer;
a second frame having a developer carrying member for carrying developer supplied from the developer container to supply the developer to the latent image;
a sealing member for sealing an opening for supplying the developer from the developer container to the developer carrying member, the sealing member being pullable between the first frame and the second frame along a pulling path in a pulling direction to open the opening;
an end seal disposed downstream of the opening with respect to the pulling direction; and
a projection disposed in contact with the end seal upstream of the end seal with respect to the pulling direction;

(b) transfer means for transferring a toner image onto a recording material from the electrophotographic photosensitive member of the process cartridge mounted to said mount; and (c) feeding means for feeding the recording material.

99. A developing apparatus for developing a latent image formed on an electrophotographic photosensitive member, said developing apparatus comprising:
a first frame having a developer container for containing developer;
a second frame having a developer carrying member for carrying developer supplied from said developer container to supply the developer to the latent image;
a seal film for sealing an opening for supplying the developer from said developer container to said developer carrying member;
a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said flexible tape is torn along said first portion to open the opening;
an end seal disposed downstream of the opening with respect to the pulling direction;
a projection disposed in contact with said end seal upstream of said end seal with respect to the pulling direction.

100. An apparatus according to claim 99, wherein said projection is provided on said second frame and projects from said second frame to said first frame.

101. An apparatus according to claim 100, wherein said projection is formed integrally with said second frame.

102. An apparatus according to claim 99 or 101, wherein bosses are disposed adjacent said seal film at both sides of the pulling path downstream of the opening in the pulling direction for limiting the pulling direction of said flexible tape.

103. An apparatus according to claim 99 or 101, wherein said first frame and said second frame push through said end seal a portion of said seal film where said seal film starts to peel off when said seal film is pulled.

104. A process cartridge detachably mountable to a main assembly of an image forming apparatus, said process cartridge comprising:
an electrophotographic photosensitive member; and
a developing device for developing a latent image formed on said electrophotographic photosensitive member, said developing device including;
a first frame having a developer container for containing developer;
a second frame having a developer carrying member for carrying developer supplied from said developer container to supply the developer to the latent image;
a seal film for sealing an opening for supplying the developer from said developer container to said developer carrying member;
a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said flexible tape is torn along said first portion to open the opening;
an end seal disposed downstream of the opening with respect to the pulling direction; and
a projection disposed in contact with said end seal upstream of said end seal with respect to the pulling direction.

105. A process cartridge according to claim 104, wherein said projection is provided on said second frame and projects from said second frame to said first frame.

106. A process cartridge according to claim 105, wherein said projection is formed integrally with said second frame.

107. A process cartridge according to claim 104 or 106, wherein bosses are disposed adjacent said seal film at both sides of the pulling path downstream of the opening in the pulling direction for limiting the pulling direction of said flexible tape.

108. A process cartridge according to claim 104 or 106, wherein said first frame and said second frame push through said end seal a portion of said seal film where said seal film starts to peel off when said seal film is pulled.

109. An image forming apparatus usable with a process cartridge detachably mountable thereto, said image forming apparatus comprising:

(a) a mount for detachably mounting a process cartridge, wherein the process cartridge includes:
an electrophotographic photosensitive member; and
a developing device for developing a latent image formed on the electrophotographic photosensitive member, the developing device including;
a first frame having a developer container for containing developer;
a second frame having a developer carrying member for carrying developer supplied from the developer container to supply the developer to the latent image;
a seal film for sealing an opening for supplying the developer from the developer container to the developer carrying member;
a flexible tape having a first portion extended along a surface of the seal film and a second portion at another surface of the seal film, the second portion being reversely extended from an end of the first portion, the second portion of the flexible tape being pullable between the first frame and the second frame along a pulling path in a pulling direction such that the flexible tape is torn along said first portion to open the opening;

an end seal disposed downstream of the opening with respect to the pulling direction; and a projection disposed in contact with the end seal upstream of the end seal with respect to the pulling direction;

(b) transfer means for transferring a toner image onto a recording material from the electrophotographic photosensitive member of the process cartridge mounted to said mount; and (c) feeding means for feeding the recording material.

110. A developing apparatus for developing a latent image formed on an electrophotographic photosensitive member, said developing apparatus comprising:

a first chamber for containing developer;

a second chamber having a developer carrying member for carrying developer supplied from said first chamber to supply the developer to the electrophotographic photosensitive member;

a hard member as a partition between said first chamber and said second chamber, said hard member being a separate member from said first chamber and said second chamber and being mounted on a member constituting said first chamber, said hard member having an opening to said first chamber for the developer;

a seal film for sealing the opening;

a flexible tape having a first portion extended along a surface of said seal film and a second portion at another surface of said seal film, said second portion being reversely extended from an end of said first portion, said second portion of said flexible tape being pullable between said first chamber and said second chamber along a pulling path in a pulling direction such that said flexible tape is torn along said first portion to open the opening;

an end seal disposed downstream of the opening with respect to the pulling direction; and a projection disposed in contact with said end seal upstream of said end seal with respect to the pulling direction.

111. An apparatus according to claim 110, wherein said projection is provided on said second chamber and projects from said second chamber to said first chamber.

112. An apparatus according to claim 111, wherein said projection is formed integrally with said second chamber.

113. An apparatus according to claim 110 or 112, wherein bosses are disposed adjacent said seal film at both sides of the pulling path downstream of the opening in the pulling direction for limiting the pulling direction of said flexible tape.

114. An apparatus according to claim 110 or 112, wherein said first chamber and said second chamber push through said end seal a portion of said seal film where said seal film starts to peel off when said seal film is pulled.

115. A process cartridge detachably mountable to a main assembly of an image forming apparatus, said process cartridge comprising:

an electrophotographic photosensitive member; and a developing device for developing a latent image formed on said electrophotographic photosensitive member, said developing device including;

a first chamber for containing developer;

a second chamber having a developer carrying member for carrying developer supplied from said first chamber to supply the developer to said electrophotographic photosensitive member;

a hard member as a partition between said first chamber and said second chamber, said hard member being a separate member from said first chamber and said second chamber and being mounted on a member constituting said first chamber, said hard member having an opening to said first chamber for the developer;

a seal film for sealing the opening;

a flexible tape having a first portion extended along a surface of said seal film and a second portion at another surface of said seal film, said second portion being reversely extended from an end of said first portion, said second portion of said flexible tape being pullable between said first chamber and said second chamber along a pulling path in a pulling direction such that said flexible tape is torn along said first portion to open the opening;

an end seal disposed downstream of the opening with respect to the pulling direction; and a projection disposed in contact with said end seal upstream of said end seal with respect to the pulling direction.

116. A process cartridge according to claim 115, wherein said projection is provided on said second chamber and projects from said second chamber to said first chamber.

117. A process cartridge according to claim 116, wherein said projection is formed integrally with said second chamber.

118. A process cartridge according to claim 115 or 117, wherein bosses are disposed adjacent said seal film at both sides of the pulling path downstream of the opening in the pulling direction for limiting the pulling direction of said flexible tape.

119. A process cartridge according to claim 115 or 117, wherein said first chamber and said second chamber push through said end seal a portion of said seal film where said seal film starts to peel off when said seal film is pulled.

120. An image forming apparatus usable with a process cartridge detachably mountable thereto, said image forming apparatus comprising:

(a) a mount for detachably mounting a process cartridge, wherein said process cartridge includes:

an electrophotographic photosensitive member; and a developing device for developing a latent image formed on the electrophotographic photosensitive member, the developing device including;

a first chamber for containing developer;

a second chamber having a developer carrying member for carrying developer supplied from the first chamber to supply the developer to the electrophotographic photosensitive member;

a hard member as a partition between the first chamber and the second chamber, the hard member being a separate member from the first chamber and the second chamber and being mounted on a member constituting the first chamber, the hard member having an opening to the first chamber for the developer;

a seal film for sealing the opening;

a flexible tape having a first portion extended along a surface of the seal film and a second portion at another surface of the seal film, the second portion being reversely extended from an end of the first portion, the second portion of the flexible tape being pullable between the first chamber and the second chamber along a pulling path in a pulling direction such that the flexible tape is torn along the first portion to open the opening;

an end seal disposed downstream of the opening with respect to the pulling direction; and a projection disposed in contact with the end seal upstream of the end seal with respect to the pulling direction;

(b) transfer means for transferring a toner image onto a recording material from the electrophotographic photosensitive member of the process cartridge mounted to said mount; and (c) feeding means for feeding the recording material.

121. A developing apparatus for developing a latent image formed on an electrophotographic photosensitive member, said developing apparatus comprising:

a first chamber for containing developer;

a second chamber having a developer carrying member for carrying developer supplied from said first chamber to supply the developer to the electrophotographic photosensitive member;

a hard member as a partition between said first chamber and said second chamber, said hard member being a separate member from said first chamber and said second chamber and being mounted on a member constituting said first chamber, said hard member having an opening to said first chamber for the developer;

a seal film for sealing the opening;

a flexible tape having a first portion extended along a surface of said seal film and a second portion at another surface of said seal film, said second portion being reversely extended from an end of said first portion, said second portion of said flexible tape being pullable between said first chamber and said second chamber along a pulling path in a pulling direction such that said flexible tape is torn along said first portion to open the opening;

projections, disposed adjacent said flexible tape at both sides of the pulling path downstream of the opening in the pulling direction, for limiting the pulling direction of said flexible tape;

an end seal disposed downstream of the opening with respect to the pulling direction; and an upstream projection disposed in contact with said end seal upstream of said end seal with respect to the pulling direction.

122. A process cartridge detachably mountable to a main assembly of an image forming apparatus, said process cartridge comprising:

an electrophotographic photosensitive drum;

a charging roller contacted to said photosensitive drum for charging said photosensitive drum;

a cleaning blade contacted to said photosensitive drum for removing residual toner from said photosensitive drum; and a developing device for developing a latent image formed on said photosensitive drum said developing device including;

a first chamber for containing developer;

a second chamber having a developer carrying member for carrying developer supplied from said first chamber to supply the developer to said photosensitive drum;

a hard member as a partition between said first chamber and said second chamber, said hard member being a separate member from said first chamber and said second chamber and being mounted on a member constituting said first chamber, said hard member having an opening to said first chamber for the developer;

a seal film for sealing the opening;

a flexible tape having a first portion extended along a surface of said seal film and a second portion at another surface of said seal film, said second portion being reversely extended from an end of said first portion, said second portion of said flexible tape being pullable between said first chamber and said second chamber along a pulling path in a pulling direction such that said flexible tape is torn along said first portion to open the opening;

projections, disposed adjacent said flexible tape at both sides of the pulling path downstream of the opening in the pulling direction, for limiting the pulling direction of said flexible tape;

an end seal disposed downstream of the opening with respect to the pulling direction; and an upstream projection disposed in contact with said end seal upstream of said end seal with respect to the pulling direction.

123. An image forming apparatus usable with a process cartridge detachably mountable thereto, said image forming apparatus comprising:

(a) a mount for detachably mounting a process cartridge, wherein the process cartridge includes:

a photosensitive drum;

a developing device for developing a latent image formed on the photosensitive drum, the developing device including;

a first chamber for containing developer;

a second chamber having a developer carrying member for carrying developer supplied from the first chamber to supply the developer to the photosensitive drum;

a hard member as a partition between the first chamber and the second chamber, the hard member being a separate member from the first chamber and the second chamber and being mounted on a member constituting the first chamber, the hard member having an opening to the first chamber for the developer;

a seal film for sealing the opening;

a flexible tape having a first portion extended along a surface of the seal film and a second portion at another surface of the seal film, the second portion being reversely extended from an end of the first portion, the second portion of the flexible tape being pullable between the first chamber and the second chamber along a pulling path in a pulling direction such that the flexible tape is torn along the first portion to open the opening;

projections, disposed adjacent the flexible tape at both sides of the pulling path downstream of the opening in the pulling direction, for limiting the pulling direction of the flexible tape;

an end seal disposed downstream of the opening with respect to the pulling direction; and an upstream projection disposed in contact with the end seal upstream of the end seal with respect to the pulling direction;

(b) transfer means for transferring a toner image onto a recording material from the photosensitive drum of the process cartridge mounted to said mount; and (c) feeding means for feeding the recording material.

124. A developing apparatus for developing a latent image formed on an electrophotographic photosensitive member, said developing apparatus comprising:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said projections are in the form of bosses.

125. An apparatus according to claim 124, wherein said projections are inserted in holes formed in an end seal disposed downstream of the opening with respect to the pulling direction of said sealing member.

126. An apparatus according to claim 125, wherein a boss is provided in contact with the end seal upstream of the end seal in the pulling direction, said boss being effective to prevent peeling of the end seal when said sealing member is pulled.

127. An apparatus according to claim 125, wherein a separate hard plate is disposed between said first frame and said second frame, and wherein said sealing member is mounted on the hard plate.

128. An apparatus according to claim 125, wherein said projections are 1 mm–3 mm away from the pulling path.

129. An apparatus according to claim 125, wherein said first frame and said second frame push through the end seal a portion of said sealing member where said sealing member starts to peel off when said sealing member is pulled.

130. A developing apparatus for developing a latent image formed on an electrophotographic photosensitive member, said developing apparatus comprising:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein a separate hard plate is disposed between said first frame and said second frame, and wherein said sealing member is mounted on the hard plate.

131. A developing apparatus for developing a latent image formed on an electrophotographic photosensitive member, said developing apparatus comprising:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said projections are 1 mm–3 mm away from the pulling path.

132. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said projections are in the form of bosses.

133. A process cartridge according to claim 132, wherein said projections are inserted in holes formed in an end seal disposed downstream of the opening with respect to the pulling direction of said sealing member.

134. A process cartridge according to claim 133, wherein an upstream boss is provided in contact with the end seal upstream of the end seal in the pulling direction, said upstream boss being effective to prevent peeling off of the end seal when said sealing member is pulled.

135. A process cartridge according to claim 133, wherein said first frame and said second frame push through the end seal a portion of said sealing member where said sealing member starts to peel off when said sealing member is pulled.

136. A process cartridge according to claim 133, wherein a separate hard plate is disposed between said first frame and said second frame, and wherein said sealing member is mounted on the hard plate.

137. A process cartridge according to claim 133, wherein said projections are 1 mm–3 mm away from the pulling path.

138. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein a separate hard plate is disposed between said first frame and said second frame, and wherein said sealing member is mounted on the hard plate.

139. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a sealing member for sealing an opening for supplying the developer from said developer container to said developer carrying member, said sealing member being pullable between said first frame and said second frame along a pulling path in a pulling direction to open the opening; and projections, disposed adjacent said sealing member at both sides of the pulling path downstream of the opening in the pulling direction, for limiting the pulling direction of said sealing member, wherein said projections are 1 mm–3 mm away from the pulling path.

140. A developing apparatus for developing a latent image formed on an image bearing member, said developing apparatus comprising:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening; and projections, disposed adjacent said flexible tape at both sides of the pulling path downstream of the opening in the pulling direction, for limiting the pulling direction of said flexible tape, wherein said projections are in the form of bosses.

141. An apparatus according to claim 140, wherein said projections are inserted in holes formed in an end seal disposed downstream of the opening with respect to the pulling direction of said flexible tape.

142. An apparatus according to claim 141, wherein an upstream boss is provided in contact with the end seal upstream of the end seal in the pulling direction, said upstream boss being effective to prevent peeling off of the end seal when said flexible tape is pulled.

143. An apparatus according to claim 141, wherein a separate hard plate is disposed between said first frame and said second frame, and wherein said seal film is mounted on the hard plate.

144. An apparatus according to claim 141, wherein said projections are 1 mm–3 mm away from the pulling path.

145. An apparatus according to claim 140, wherein said first frame and said second frame push through the end seal a portion of said seal film where said seal film starts to peel off when said flexible tape is pulled.

146. A developing apparatus for developing a latent image formed on an image bearing member, said developing apparatus comprising:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening; and projections, disposed adjacent said flexible tape at both sides of the pulling path downstream of the opening in the pulling direction, for limiting the pulling direction of said flexible tape, wherein a separate hard plate is disposed between said first frame and said second frame, and wherein said seal film is mounted on the hard plate.

147. A developing apparatus for developing a latent image formed on an image bearing member, said developing apparatus comprising:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening; and projections, disposed adjacent said flexible tape at both sides of the pulling path downstream of the opening in the pulling direction, for limiting the pulling direction of said flexible tape, wherein said projections are 1 mm–3 mm away from the pulling path.

148. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening;

projections, disposed adjacent said flexible tape at both sides of the pulling path downstream of the opening in the pulling direction, for limiting the pulling direction of said flexible tape, wherein said projections are in the form of bosses.

149. A process cartridge according to claim 148, wherein said projections are inserted in holes formed in an end seal disposed downstream of the opening with respect to the pulling direction of said flexible tape.

150. A process cartridge according to claim 149, wherein an upstream boss is provided in contact with the end seal upstream of the end seal in the pulling direction, said upstream boss being effective to prevent peeling of the end seal when said flexible tape is pulled.

151. A process cartridge according to claim 149, wherein a separate hard plate is disposed between said first frame and said second frame, and wherein said seal film is mounted on the hard plate.

152. A process cartridge according to claim 149, wherein said projections are 1 mm–3 mm away from the pulling path.

153. A process cartridge according to claim 149, wherein said first frame and said second frame push through the end seal a portion of said seal film where said seal film starts to peel off when said flexible tape is pulled.

154. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening;

projections, disposed adjacent said flexible tape at both sides of the pulling path downstream of the opening in the pulling direction, for limiting the pulling direction of said flexible tape, wherein a separate hard plate is disposed between said first frame and said second frame, and wherein said seal film is mounted on the hard plate.

155. A process cartridge detachably mountable to a main assembly of an image forming apparatus, said process cartridge comprising:

an electrophotographic photosensitive member; and a developing device for developing a latent image formed on said electrophotographic photosensitive member, said developing device including:

a first frame having a developer container for containing developer;

a second frame having a developer carrying member for carrying developer supplied from said developer container to supply the developer to the latent image;

a seal film for sealing an opening for supplying the developer from said developer container to said developer carrying member;

a flexible tape having a first portion extended along a surface of said seal film and a second portion at another surface of said seal film, said second portion being reversely extended from an end of said first portion, said second portion of said flexible tape being pullable between said first frame and said second frame along a pulling path in a pulling direction such that said seal film is torn along said first portion to open the opening;

projections, disposed adjacent said flexible tape at both sides of the pulling path downstream of the opening in the pulling direction, for limiting the pulling direction of said flexible tape, wherein said projections are 1 mm–3 mm away from the pulling path.

156. A process cartridge detachably mountable to a main assembly of an image forming apparatus, said process cartridge comprising:

an electrophotographic photosensitive drum;

a charging roller contacted to said photosensitive drum for charging said photosensitive drum;

a cleaning blade contacted to said photosensitive drum for removing residual toner from said photosensitive drum; and a developing device for developing a latent image formed on said photosensitive drum, said developing device including:

a first chamber for containing developer;

a second chamber having a developing roller for carrying developer supplied from said first chamber and for supplying the developer to said photosensitive drum;

a hard member as a partition between said first chamber and said second chamber, said hard member being a separate member from said first chamber and said second chamber and being mounted on a member constituting said first chamber, said hard member having a developer supply opening which opens to said second chamber for the developer;

a seal film for sealing the developer supply opening;

a flexible tape having a first portion extended along a surface of said seal film and a second portion at another surface of said seal film, said second portion being reversely extended from an end of said first portion, and said second portion of said flexible tape being pullable between said first chamber and said second chamber along a pulling path in a pulling direction such that said seal film is torn along said first portion to open the developer supply opening;

an end seal, disposed downstream of the developer supply opening with respect to the pulling direction, for preventing leakage of the developer through an area between said first chamber and said second chamber, said first chamber and said second chamber being coupled with each other;

projections, disposed adjacent said flexible tape at both sides of the pulling path downstream of the developer supply opening in the pulling direction, for limiting the pulling direction of said flexible tape, wherein said projections are provided in said second chamber and said first chamber is provided with openings for receiving said projections, and said projections are inserted in holes formed in said end seal; and an upstream projection disposed in contact with a lateral end of said end seal upstream of said end seal with respect to the pulling direction, wherein said upstream projection is provided in said second chamber.

* * * * *

UNITED STATES PATENT AND TRADEMARK OFFICE

CERTIFICATE OF CORRECTION

PATENT NO. : 5,752,131

DATED : May 12, 1998

INVENTOR(S) : YASUO FUJIWARA ET AL.

It is certified that error appears in the above-identified patent and that said Letters Patent is hereby corrected as shown below:

COLUMN 3

Line 31, "dimension" should read --dimensions--.

COLUMN 4

Line 18, "products" should read --projects--.
Line 65, "pairs," should read --pairs--.

COLUMN 5

Line 13, "having" should be deleted.
Line 14, "been" should be deleted.

COLUMN 9

Line 39, "the" should read --a--; and
"is" should be deleted.

COLUMN 11

Line 2, "38.5." should read --38.5 mm.--.
Line 29, "show" should read --shown--.

COLUMN 12

Line 10, "the liability" should read --this liability--.
Line 43, "and" should read --the--.

UNITED STATES PATENT AND TRADEMARK OFFICE

CERTIFICATE OF CORRECTION

PATENT NO. : 5,752,131

DATED : May 12, 1998

INVENTOR(S) : YASUO FUJIWARA ET AL.

It is certified that error appears in the above-identified patent and that said Letters Patent is hereby corrected as shown below:

COLUMN 14

Line 6, "upon" should read --when--.
Line 15, "1" should read --1,--.

COLUMN 17

Line 23, "patter" should read --pattern--.
Line 33, "narrower" should read --is narrower--.
Line 38, "the" should read --if the--.
Line 42, "used," should read --used, is--.
Line 48, "frame" should read --the frame--.
Line 67, "$\theta$" should read --angle $\theta$--.

COLUMN 18

Line 7, "fall" should read --falls--.

COLUMN 20

Line 21, "of the" should read --of--.
Line 47, "inevitable" should read --inevitable,--.
Line 63, "layer" should read --layer is used--.

COLUMN 21

Line 30, "adhesiveness having" should read --adhesive--.

UNITED STATES PATENT AND TRADEMARK OFFICE

CERTIFICATE OF CORRECTION

PATENT NO. : 5,752,131

DATED : May 12, 1998

INVENTOR(S) : YASUO FUJIWARA ET AL.

It is certified that error appears in the above-identified patent and that said Letters Patent is hereby corrected as shown below:

COLUMN 21 (CONTINUED)

Line 40, "changes" should read --change--.

COLUMN 22

Line 3, "of" should be deleted.
Line 4, "μm-thick" should read --μm thick--.
Line 6, "of 38" should read --38--.
Line 7, "μm-thick" should read --μm thick--.
Line 8, "of" should be deleted; and "μm-thick" should read --μm thick--.
Line 30, "automization" should read --automation--.
Line 46, "like," should read --like is reduced--.

COLUMN 23

Line 1, "automatization" should read --automation--.
Line 14, "automatization" should read --automation--.
Line 28, "Automatization" should read --Automation--.
Line 50, "automatization" should read --automation--.
Line 63, "automatization" should read --automation--.

COLUMN 24

Line 14, "The use is made with" should read --Use is made of--.

UNITED STATES PATENT AND TRADEMARK OFFICE

CERTIFICATE OF CORRECTION

PATENT NO. : 5,752,131

DATED : May 12, 1998

INVENTOR(S) : YASUO FUJIWARA ET AL.

It is certified that error appears in the above-identified patent and that said Letters Patent is hereby corrected as shown below:

COLUMN 25

Line 11, "wave" should read --weight--.

COLUMN 27

Line 57, "clack" should read --cracking--.

COLUMN 39

Line 61, "flexible" should read --flexible tape--.

COLUMN 47

Line 58, "drum" should read --drum,--.

Signed and Sealed this

Eighth Day of June, 1999

*Attest:*

Q. TODD DICKINSON

*Attesting Officer*

*Acting Commissioner of Patents and Trademarks*